US011771156B2

(12) United States Patent
Pezzimenti et al.

(10) Patent No.: US 11,771,156 B2
(45) Date of Patent: Oct. 3, 2023

(54) INSULATED VENTED GARMENT FORMED USING NON-WOVEN POLYMER SHEETS

(71) Applicant: NIKE, Inc., Beaverton, OR (US)

(72) Inventors: Luke A. Pezzimenti, Portland, OR (US); Eric R. Noll, Portland, OR (US); Jeffrey K. Ingram, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/924,781

(22) Filed: Jul. 9, 2020

(65) Prior Publication Data

US 2020/0337399 A1 Oct. 29, 2020

Related U.S. Application Data

(63) Continuation of application No. 15/286,913, filed on Oct. 6, 2016, now Pat. No. 10,743,596.

(51) Int. Cl.

| | |
|---|---|
| ***A41D 27/28*** | (2006.01) |
| ***A41D 27/24*** | (2006.01) |
| ***A41D 31/06*** | (2019.01) |
| ***A41D 3/00*** | (2006.01) |

(52) U.S. Cl.

CPC ..... *A41D 27/28* (2013.01); *A41D 3/00* (2013.01); *A41D 27/24* (2013.01); *A41D 27/245* (2013.01); *A41D 31/065* (2019.02); *A41D 2300/50* (2013.01)

(58) Field of Classification Search

CPC ..... A41D 27/24; A41D 27/245; A41D 27/28; A41D 3/00; A41D 31/065; A41D 2300/50; A41D 2400/10

See application file for complete search history.

(56) References Cited

U.S. PATENT DOCUMENTS

| | | | |
|---|---|---|---|
| 317,711 | A | 5/1885 | Brinkmann |
| 385,306 | A | 6/1888 | Helwitz |
| 1,252,187 | A | 1/1918 | Shane |
| 1,252,188 | A | 1/1918 | Shane |
| 1,612,010 | A | 12/1926 | Gray |
| 1,788,713 | A | 1/1931 | John et al. |

(Continued)

FOREIGN PATENT DOCUMENTS

| | | | |
|---|---|---|---|
| CN | 2337793 | Y | 9/1999 |
| CN | 1864574 | A | 11/2006 |

(Continued)

OTHER PUBLICATIONS

Extended European Search Report received for European Patent Application No. 21163471.2, dated Apr. 13, 2021, 8 pages.

(Continued)

*Primary Examiner* — Jocelyn Bravo

(74) *Attorney, Agent, or Firm* — SHOOK, HARDY & BACON L.L.P.

(57) ABSTRACT

Aspects herein provide for a method of manufacturing a vented insulated garment using non-woven polymer sheets and garments produced therefrom. The method generally comprises providing a non-woven polymer sheet having one or more voided portions, positioning the sheet between two textile layers, and bonding the textile layers together at areas corresponding to the voided portions in the non-woven polymer sheet to form a seam. The seam may be optionally perforated.

20 Claims, 14 Drawing Sheets

(56) References Cited

U.S. PATENT DOCUMENTS 1,788,731 A 1/1931 Mishel
2,084,173 A 6/1937 Louis
2,121,836 A 6/1938 Steinberger
2,353,984 A 7/1944 Anthony
2,372,632 A 3/1945 Webb
2,385,124 A * 9/1945 Barone ..... A41D 27/28 112/426
2,464,380 A 3/1949 Daiber
2,466,911 A 4/1949 Raymond
2,540,547 A 2/1951 Rodert
2,851,390 A 9/1958 Chavannes
3,115,564 A 12/1963 Stacy
3,405,674 A 10/1968 Coates et al.
3,482,567 A 12/1969 Franklin
3,562,041 A 2/1971 Robertson
3,706,102 A 12/1972 Grenier
3,761,962 A 10/1973 Myers
3,771,170 A 11/1973 Leon
3,801,987 A * 4/1974 Thompson, Jr. ..... A41D 27/10 2/125
3,819,465 A 6/1974 Parsons et al.
3,852,144 A 12/1974 Parry
3,876,493 A 4/1975 Gilmore
4,039,709 A 8/1977 Newman
4,048,675 A 9/1977 Griffin
4,115,610 A 9/1978 Wortman
4,181,993 A 1/1980 McDaniel
4,185,327 A 1/1980 Markve
4,251,312 A 2/1981 Ziegler et al.
4,311,542 A 1/1982 Mueller et al.
4,370,754 A 2/1983 Donzis
4,396,039 A 8/1983 Klenk et al.
4,471,759 A 9/1984 Anderson et al.
4,496,407 A 1/1985 Lowery et al.
4,502,153 A 3/1985 Apedes et al.
4,547,906 A 10/1985 Nishida et al.
4,560,427 A 12/1985 Flood
4,583,247 A * 4/1986 Fingerhut ..... B32B 3/266 2/81
4,603,069 A 7/1986 Haq et al.
4,604,152 A 8/1986 Liukko
4,608,715 A 9/1986 Miller et al.
4,610,750 A 9/1986 Mango
4,625,336 A 12/1986 Derderian
4,693,771 A 9/1987 Payet et al.
4,713,131 A 12/1987 Obeda
4,716,598 A 1/1988 Bertram
4,737,212 A 4/1988 Emrich et al.
4,756,937 A 7/1988 Mentzer
4,788,972 A 12/1988 Debusk
4,791,685 A 12/1988 Maibauer
4,938,817 A 7/1990 Langley
4,962,554 A 10/1990 Tesch
4,971,041 A 11/1990 Millikan et al.
5,001,783 A 3/1991 Grilliot et al.
5,003,902 A 4/1991 Benstock et al.
5,021,280 A 6/1991 Farnworth et al.
5,048,126 A 9/1991 McLaughlin
5,067,178 A 11/1991 Katchka
5,131,097 A 7/1992 Grilliot et al.
5,150,476 A 9/1992 Statham et al.
5,165,115 A 11/1992 Stanislaw
5,168,576 A 12/1992 Krent et al.
5,201,075 A 4/1993 Svetich
5,255,392 A 10/1993 Stanislaw
5,267,519 A * 12/1993 Uglene ..... B32B 5/18 112/440
5,267,591 A 12/1993 Wakabayashi et al.
5,408,700 A 4/1995 Reuben et al.
5,445,863 A 8/1995 Slagle et al.
5,446,927 A 9/1995 Weldon
5,483,713 A 1/1996 Kikuchi et al.
5,526,534 A 6/1996 Lazar
5,545,128 A 8/1996 Hayes et al.
5,665,196 A 9/1997 Combe et al.
5,692,245 A 12/1997 Reuben
5,704,064 A 1/1998 van der Sleesen
5,713,079 A 2/1998 Simon et al.
5,787,502 A 8/1998 Middleton
5,799,600 A 9/1998 Reuben
5,885,679 A 3/1999 Yasue et al.
5,924,134 A 7/1999 Taylor et al.
5,935,878 A 8/1999 Glasser
6,009,560 A 1/2000 McKenney et al.
6,018,819 A 2/2000 King et al.
6,035,442 A 3/2000 Marando
6,038,700 A 3/2000 Aldridge et al.
6,049,908 A 4/2000 Bullock et al.
6,076,195 A 6/2000 Klein
6,076,196 A 6/2000 Masumoto
6,112,328 A 9/2000 Spector
6,182,297 B1 2/2001 Duren et al.
6,263,511 B1 7/2001 Moretti
6,279,161 B1 8/2001 Johnston
6,332,221 B1 12/2001 Gracey
6,339,843 B1 1/2002 Grilliot et al.
6,405,375 B1 6/2002 Sardi
6,427,242 B1 8/2002 Bush et al.
6,547,327 B1 4/2003 Yates
6,557,479 B2 5/2003 Alberts et al.
6,579,403 B2 6/2003 Tolbert et al.
6,632,501 B2 10/2003 Brownstein et al.
6,649,251 B1 11/2003 Druecke et al.
6,743,498 B2 * 6/2004 Fourmeux ..... A41D 31/08 428/920
6,805,181 B2 10/2004 Blundell et al.
6,808,791 B2 10/2004 Curro et al.
6,817,037 B1 11/2004 King
6,928,665 B1 8/2005 Yates
7,005,021 B2 2/2006 Kramer
7,017,191 B2 3/2006 Golde
7,037,569 B2 5/2006 Curro et al.
7,051,373 B1 5/2006 Krall
7,094,714 B2 8/2006 Li et al.
7,111,328 B2 9/2006 Bay
7,140,048 B2 11/2006 Wallerstein
7,147,911 B2 12/2006 Baychar
7,437,774 B2 10/2008 Baron et al.
7,578,005 B2 8/2009 Vereen
7,757,311 B2 7/2010 Garneau
7,827,624 B1 11/2010 Cole
7,926,124 B2 4/2011 Hunter et al.
8,028,386 B2 10/2011 Rock et al.
8,057,878 B2 11/2011 Lo et al.
8,070,905 B2 12/2011 Brennan
8,127,701 B2 3/2012 Harward
8,133,824 B2 3/2012 Harber
8,377,536 B2 2/2013 Cienski
8,399,085 B2 3/2013 Moore et al.
8,458,819 B1 6/2013 Hoole
8,518,511 B2 8/2013 Harward
D693,095 S 11/2013 Grant
8,578,516 B2 11/2013 Li
8,756,714 B2 6/2014 Reimer
D713,620 S 9/2014 Pezzimenti et al.
D713,621 S 9/2014 Pezzimenti et al.
D714,022 S 9/2014 Mong et al.
8,828,167 B2 9/2014 Hannon
8,840,745 B2 9/2014 Green
9,023,161 B2 5/2015 Ma et al.
9,138,060 B2 9/2015 Vainberg et al.
9,247,830 B2 2/2016 Waters et al.
9,392,825 B2 7/2016 Pezzimenti et al.
9,609,901 B2 4/2017 Nordstrom et al.
9,881,093 B2 1/2018 Butler
10,111,480 B2 10/2018 Pezzimenti
10,362,820 B2 7/2019 Pezzimenti et al.
10,694,797 B2 6/2020 Pezzimenti et al.
10,842,211 B2 11/2020 Inoue et al.
2002/0016122 A1 2/2002 Curro et al.
2002/0022426 A1 2/2002 Curro et al.
2002/0034912 A1 3/2002 Curro et al.
2002/0034913 A1 3/2002 Curro et al.
2002/0114918 A1 8/2002 Mossbeck et al.

(56) References Cited

U.S. PATENT DOCUMENTS

| | | | | |
|---|---|---|---|---|
| 2002/0183671 | A1 | 12/2002 | Henderson et al. | |
| 2003/0033656 | A1 | 2/2003 | Jaeger | |
| 2003/0126673 | A1 | 7/2003 | Yardley | |
| 2003/0138586 | A1 | 7/2003 | Fowler | |
| 2003/0208831 | A1 | 11/2003 | Lazar et al. | |
| 2004/0083538 | A1 | 5/2004 | Thomas | |
| 2004/0111782 | A1 | 6/2004 | Lenormand et al. | |
| 2004/0197534 | A1 | 10/2004 | Miller et al. | |
| 2005/0124256 | A1 | 6/2005 | Mason et al. | |
| 2005/0159056 | A1 | 7/2005 | Lap et al. | |
| 2005/0249917 | A1 | 11/2005 | Trentacosta et al. | |
| 2006/0059601 | A1 | 3/2006 | Opitz et al. | |
| 2006/0135016 | A1 | 6/2006 | Iwasaki | |
| 2006/0165939 | A1 | 7/2006 | Hottner | |
| 2006/0185053 | A1 | 8/2006 | Wittmann et al. | |
| 2006/0240234 | A1 | 10/2006 | O'Neill et al. | |
| 2007/0026186 | A1 | 2/2007 | Chapuis | |
| 2007/0083985 | A1 | 4/2007 | Nathan et al. | |
| 2007/0186832 | A1 | 8/2007 | Kishi et al. | |
| 2007/0245448 | A1 | 10/2007 | Bury | |
| 2007/0294800 | A1 | 12/2007 | Huang | |
| 2008/0005823 | A1 | 1/2008 | Hung | |
| 2008/0127395 | A1 | 6/2008 | Blauer et al. | |
| 2008/0289078 | A1* | 11/2008 | Mather | A41D 13/0015 2/243.1 |
| 2008/0295216 | A1 | 12/2008 | Nordstrom et al. | |
| 2009/0089911 | A1 | 4/2009 | Smith | |
| 2009/0155543 | A1 | 6/2009 | Fowler | |
| 2009/0233042 | A1 | 9/2009 | Sadato et al. | |
| 2009/0314696 | A1 | 12/2009 | Trentacosta et al. | |
| 2010/0030170 | A1 | 2/2010 | Keller et al. | |
| 2010/0122394 | A1 | 5/2010 | Lambertz | |
| 2010/0138977 | A1 | 6/2010 | Lin | |
| 2010/0143669 | A1 | 6/2010 | Abrams | |
| 2010/0281595 | A1 | 11/2010 | Gernes | |
| 2010/0287680 | A1 | 11/2010 | Johnson et al. | |
| 2010/0291825 | A1 | 11/2010 | Johnson et al. | |
| 2011/0072558 | A1 | 3/2011 | Berns | |
| 2011/0119811 | A1 | 5/2011 | Rock et al. | |
| 2011/0125125 | A1 | 5/2011 | Schneider et al. | |
| 2011/0296580 | A1 | 12/2011 | Demarest et al. | |
| 2011/0302686 | A1 | 12/2011 | Chapuis | |
| 2012/0005829 | A1 | 1/2012 | Waters et al. | |
| 2012/0005831 | A1 | 1/2012 | Waters et al. | |
| 2012/0017346 | A1 | 1/2012 | Reimer | |
| 2012/0114883 | A1 | 5/2012 | Kapur et al. | |
| 2012/0222189 | A1 | 9/2012 | Sokolowski et al. | |
| 2012/0260396 | A1* | 10/2012 | Mordecai | A41D 31/06 2/97 |
| 2012/0328824 | A1 | 12/2012 | Cartabbia | |
| 2013/0014317 | A1 | 1/2013 | Ly | |
| 2013/0031703 | A1* | 2/2013 | Curtis | A62B 17/003 2/455 |
| 2013/0038104 | A1 | 2/2013 | Burns et al. | |
| 2013/0061366 | A1 | 3/2013 | Pezzimenti | |
| 2013/0177731 | A1 | 7/2013 | Moriarty | |
| 2013/0255103 | A1 | 10/2013 | Dua et al. | |
| 2013/0276201 | A1* | 10/2013 | Pezzimenti | A41D 13/002 2/69 |
| 2013/0277349 | A1 | 10/2013 | Pezzimenti | |
| 2014/0304896 | A1 | 10/2014 | Nordstrom et al. | |
| 2014/0349057 | A1 | 11/2014 | Blackford et al. | |
| 2015/0044943 | A1 | 2/2015 | Marshall et al. | |
| 2016/0183613 | A1 | 6/2016 | Martin | |
| 2016/0213077 | A1 | 7/2016 | Sung | |
| 2016/0235147 | A1 | 8/2016 | Pezzimenti et al. | |
| 2016/0278459 | A1 | 9/2016 | Hilty | |
| 2016/0366962 | A1 | 12/2016 | Ilcheva et al. | |
| 2016/0366963 | A1 | 12/2016 | Koshkaroff et al. | |
| 2017/0028669 | A1 | 2/2017 | Regester et al. | |
| 2017/0065005 | A1 | 3/2017 | Nordstrom | |
| 2017/0099898 | A1 | 4/2017 | Pezzimenti | |
| 2017/0099899 | A1 | 4/2017 | Pezzimenti et al. | |
| 2017/0105467 | A1 | 4/2017 | Pezzimenti et al. | |
| 2017/0245560 | A1 | 8/2017 | Pezzimenti et al. | |
| 2018/0098584 | A1 | 4/2018 | Pezzimenti et al. | |
| 2018/0098586 | A1 | 4/2018 | Pezzimenti et al. | |
| 2018/0098588 | A1 | 4/2018 | Pezzimenti et al. | |
| 2019/0289939 | A1 | 9/2019 | Pezzimenti et al. | |
| 2019/0351094 | A1 | 11/2019 | Maher et al. | |
| 2020/0000640 | A1 | 1/2020 | Mondal et al. | |
| 2022/0322772 | A1 | 10/2022 | Pezzimenti | |

FOREIGN PATENT DOCUMENTS

| | | | | |
|---|---|---|---|---|
| CN | 2927724 | Y | 8/2007 | |
| CN | 101209129 | A | 7/2008 | |
| CN | 101731767 | A | 6/2010 | |
| CN | 201782000 | U | 4/2011 | |
| CN | 201929015 | U | 8/2011 | |
| CN | 201999883 | U | 10/2011 | |
| CN | 202122098 | U | 1/2012 | |
| CN | 202233137 | U | 5/2012 | |
| CN | 202293468 | U | 7/2012 | |
| CN | 202368006 | U | 8/2012 | |
| CN | 202375039 | U | 8/2012 | |
| CN | 103358606 | A | 10/2013 | |
| CN | 103750584 | A | 4/2014 | |
| CN | 203969250 | U | 12/2014 | |
| CN | 203986201 | U | 12/2014 | |
| CN | 204132498 | U | 2/2015 | |
| CN | 204340295 | U | 5/2015 | |
| CN | 205072100 | U | 3/2016 | |
| CN | 206182403 | U | 5/2017 | |
| EP | 1325976 | A2 | 7/2003 | |
| EP | 2617306 | A1 | 7/2013 | |
| EP | 3358975 | B1 | 9/2020 | |
| GB | 2256359 | A | 12/1992 | |
| JP | 60-152630 | U | 10/1985 | |
| JP | 2001-92901 | A | 4/2001 | |
| JP | 2001-192901 | A | 7/2001 | |
| JP | 2004211905 | A | 7/2004 | |
| JP | 2005-226173 | A | 8/2005 | |
| JP | 2013-129940 | A | 7/2013 | |
| JP | 3185237 | U | 7/2013 | |
| KR | 10-2009-0113413 | A | 11/2009 | |
| KR | 20-0454066 | Y1 | 6/2011 | |
| KR | 20-0455836 | Y1 | 9/2011 | |
| WO | 03/057975 | A1 | 7/2003 | |
| WO | 2004/082413 | A1 | 9/2004 | |
| WO | 2013/070086 | A1 | 5/2013 | |
| WO | 2014/062067 | A1 | 4/2014 | |
| WO | 2014/087161 | A1 | 6/2014 | |
| WO | 2017/062539 | A1 | 4/2017 | |
| WO | WO-2018046756 | A1 * | 3/2018 | A41D 27/28 |

OTHER PUBLICATIONS

Notice of Allowance received for Canadian Patent Application No. 3034404, dated Mar. 26, 2021, 1 page.

Notice of Allowance received for U.S. Appl. No. 15/391,187, dated Aug. 28, 2020, 5 pages.

Patent Board Decision received for U.S. Appl. No. 15/391,187, dated Jul. 24, 2020, 7 pages.

Final Office Action received for U.S. Appl. No. 15/255,603, dated Oct. 28, 2021, 9 pages.

Final Office Action received for U.S. Appl. No. 15/286,929, dated Oct. 21, 2021, 15 pages.

Office Action received for European Patent Application No. 18729254.5, dated Nov. 3, 2021, 5 pages.

Final Office Action received for U.S. Appl. No. 15/254,749, dated Jan. 13, 2022, 7 pages.

Non-Final Office Action received for U.S. Appl. No. 15/255,603, dated Jan. 12, 2022, 15 pages.

Intention to Grant received for European Patent Application No. 17787759.4, dated Jun. 11, 2021, 5 pages.

Non-Final Office action received for U.S. Appl. No. 16/439,426, dated Jun. 8, 2021, 20 pages.

Office Action received for Canadian Patent Application No. 3001345, dated May 28, 2021, 4 pages.

Final Office Action received for U.S. Appl. No. 15/286,929, dated Jan. 8, 2021, 13 pages.

(56) References Cited

OTHER PUBLICATIONS

Non-Final Office Action received for U.S. Appl. No. 15/255,603, dated Jan. 26, 2021, 7 pages.
Notice of Allowance received for U.S. Appl. No. 15/724,702, dated Feb. 1, 2021, 7 pages.
Intention to Grant received for European Patent Application No. 17787086.2, dated Nov. 13, 2020, 6 pages.
Office Action received for Canadian Patent Application No. 3036223, dated Nov. 30, 2020, 5 pages.
Office Action received for Canadian Patent Application No. 3056451, dated Nov. 6, 2020, 3 pages.
Intention to Grant received for European Patent Application No. 17787734.7, dated Sep. 24, 2021, 5 pages.
Notice of Allowance received for U.S. Appl. No. 16/439,426, dated Sep. 15, 2021, 7 pages.
"78678 North End Sport Pursuit Ladies' 3-Layer Light Bonded Hybrid Soft Shell Jacket with Laser Perforation", Seasons Outfitters, Available on Internet at: <http://www.seasonsoutfitters.com/index.php/outerwear-32/waterproof/78678-pursuit-ladies-3-layer-light-bonded-hybrid-soft-shell-jacket-with-laser-perforation.html>, Accessed on Jan. 23, 2015, 1 page.
"88680: Ventilate—Men's Seam-Sealed Insulated Jacket", Alphabroder, Available on Internet at: <http://www.ashcity.com/en-ca/products/outerwear/insulated-seam-sealed/88680-ventilate-mens-nbsp-3bseam-sealed-insulated-jacket.html>, Accessed on Jan. 23, 2015, 2 pages.
Angie, "Trend: Quilted Textures", youlookfab, Available on Internet at: <http://youlookfab.com/2013/07/15/trend-quilted-textures/>, Jul. 15, 2013, 2 pages.
Non-Final Office Action received for U.S. Appl. No. 15/724,702, dated Sep. 30, 2020, 12 pages.
Office Action received for Canadian Patent Application No. 3034298, dated Oct. 7, 2020, 4 pages.
Office Action received for Canadian Patent Application No. 3034404, dated Oct. 7, 2020, 5 pages.
Office Action received for Canadian Patent Application No. 3034446, dated Oct. 9, 2020, 3 pages.
Office Action received for Canadian Patent Application No. 3036225, dated Oct. 16, 2020, 4 pages.
Office Action received for European Patent Application No. 17787734.7, dated Oct. 16, 2020, 5 pages.
Office Action received for European Patent Application No. 17787759.4, dated Oct. 27, 2020, 7 pages.
Notice of Allowance received for Canadian Patent Application No. 3034446, dated May 18, 2021, 1 page.
Notice of Allowance received for Canadian Patent Application No. 3036223, dated May 10, 2021, 1 page.
Final Office Action received for U.S. Appl. No. 15/988,138, dated Feb. 28, 2022, 12 pages.
Non-Final Office Action received for U.S. Appl. No. 15/597,540, dated Mar. 4, 2022, 16 pages.
Office Action received for Canadian Patent Application No. 3,056,451, dated Mar. 2, 2022, 3 pages.
Office Action received for European Patent Application No. 21163471.2, dated Mar. 18, 2022, 6 pages.
Office Action received for Sri Lankan Patent Application No. 20396, dated Feb. 15, 2022, 1 page.
Non-Final Office Action received for U.S. Appl. No. 15/286,929, dated Apr. 15, 2021, 13 pages.
Notice of Allowance received for Canadian Patent Application No. 3034298, dated Feb. 23, 2021, 1 page.
Notice of Allowance received for Canadian Patent Application No. 3036225, dated Mar. 26, 2021, 1 page.
Office Action received for European Patent Application No. 17765040.5, dated Mar. 12, 2021, 7 pages.
Office Action received for European Patent Application No. 17765042.1, dated Mar. 23, 2021, 5 pages.
Office Action received for European Patent Application No. 17787734.7, dated Mar. 15, 2021, 5 pages.
Office Action received for European Patent Application No. 17787759.4, dated Mar. 19, 2021, 4 pages.
Office Action received for Canadian Patent Application No. 3056451, dated Jul. 28, 2021, 3 pages.
Notice of Allowance received for Canadian Patent Application No. 3001345, dated May 3, 2022, 1 page.
Final Office Action received for U.S. Appl. No. 15/597,540, dated Jun. 23, 2022, 15 pages.
Notice of Allowance received for U.S. Appl. No. 15/255,603, dated Sep. 30, 2022, 10 pages.
Final Office Action received for U.S. Appl. No. 15/255,603, dated May 18, 2022, 14 pages.
Notice of Allowance received for U.S. Appl. No. 15/254,749, dated Mar. 30, 2022, 9 pages.
Non- Final Office Action received for U.S. Appl. No. 15/597,540, dated Nov. 23, 2022, 12 pages.
Office Action received for Canadian Patent Application No. 3,125,031, dated Oct. 28, 2022, 4 pages.
Notice of Allowance received for Canadian Patent Application No. 3,056,451, dated Nov. 8, 2022, 1 page.
Non-Final Office Action received for U.S. Appl. No. 17/208,548, dated Dec. 14, 2022, 10 pages.
Office Action received for European Patent Application No. 17765040.5, dated Jan. 24, 2023, 5 pages.
Office Action received for European Patent Application No. 17765042.1, dated Jan. 26, 2023, 5 pages.
Office Action received for European Patent Application No. 21163471.2, dated Jan. 24, 2023, 4 pages.
"Barbour Mens Chukka Quilted Jacket Military Brown Navy", Barbour, Available on Internet at: <http://www.coveredbridgecyclery.com/barbour-mens-chukka-quilted-jacket-military-brown-navy-1423.html>, Accessed on Jan. 23, 2015, 1 page.
Bendzovski, Daniel, "Trend-sandwich: Exploring New Ways of Joining Inspiration, Such as Different Kinds of Trends, Through Processes of Morphing and Melding Different Trendy Garments and Materials, for New Methods, Garment Types, Materials and Expressions", MA Fashion Design Thesis, University of Boras, 2015, 224 pages.
"C9 Loft Jacket", Houdini, Available on Internet at: <http://www.houdinisportswear.com/en/women/womens-c9-loft-jacket>, Accessed on Jan. 23, 2015, 1 page.
"Greenland Baffled Jacket", Marmot For Life, Available on Internet at: <http://marmot.com/products/details/greenland-baffled-jacket>, Accessed on Jan. 23, 2015, 1 page.
"Laser Perforated Jacket", Akris Punto, Nordstrom, Available on Internet at: <http://shop.nordstrom.com/s/akris-punto-laser-perforated-jacket/3667112>, Accessed on Jan. 23, 2015, 1 page.
"Mavic Helium Jacket (Men's)", MEC, Available on Internet at: <http://www.mec.ca/product/5038-526/mavic-helium-jacket-mens/>, Accessed on Jan. 23, 2015, 1 page.
"Nike Aeroloft", Nike, Available on Internet at: <http://www.nike.com/us/en_us/c/running/aeroloft>, Accessed on Jan. 23, 2015, 1 page.
"Pizzoli' Knit & Quilted Jacket", Boss Hugo Boss, Nordstrom, Item #73989, Available on Internet at: <http://shop.nordstrom.com/s/boss-hugo-boss-pizzoli-knit-quilted-jacket/3782194>, Accessed on Jan. 23, 2015, 1 page.
"Quilted Front Down Sweater Jacket", Moncler, Nordstrom, Item #803724, Available on Internet at: <http://shop.nordstrom.com/s/moncler-quilted-front-down-sweater-jacket/3900159>, Accessed on Jan. 23, 2015, 1 page.
"Salomon Men's S-Lab Hybrid Jacket", Running Warehouse, Model No. L36344900, Available on Internet at: <http://www.runningwarehouse.com/Salomon_Mens_S-Lab_Hybrid_Jacket/descpage-SMSLHJ.html>, Accessed on Jan. 23, 2015, 1 page.
"Woman's Aconcagua Jacket", The North Face, Available on Internet at: <http://www.thenorthface.com/catalog/sc-gear/womens-jackets-vests/women-8217-s-aconcaguajacket.html?from=subCat&variationId=R8F &cm_mmc=Google-_-ProductListingAds-_-ProductTerms-_-The+North+Face+Women+s+Aconcagua+Jacket&gclid=Cj0KEQiAiuOIBRCU-8D6idaPz_UBEiQAzTagNG1Cj7lahwV8b1m5Eh-Q2W_EcYDilCjgsF8EXvFMbEaApbd8P8HAQ>, Accessed on Jan. 23, 2015, 1 page.

(56) References Cited

OTHER PUBLICATIONS

"Women's Better than Naked™ Cool Jacket", The North Face, Available on Internet at: <http://www.thenorthface.com/catalog/sc-gear/women-39-s-better-than-naked-cool-jacket.html>, Accessed on Jan. 23, 2015, 1 page.
Final Office Action received for U.S. Appl. No. 15/597,540, dated Apr. 12, 2023, 15 pages.
Notice of Allowance Received for U.S. Appl. No. 17/208,548, dated Mar. 29, 2023, 10 pages.

* cited by examiner

INSULATED VENTED GARMENT FORMED USING NON-WOVEN POLYMER SHEETS

CROSS-REFERENCE TO RELATED APPLICATIONS

This application assigned U.S. application Ser. No. 16/924,781, filed Jul. 9, 2020, and entitled "Insulated Vented Garment Formed Using Non-Woven Polymer Sheets" is a Continuation Application of U.S. application Ser. No. 15/286,913, filed Oct. 6, 2016, and entitled "Insulated Vented Garment Formed Using Non-Woven Polymer Sheets" which issued as U.S. Pat. No. 10,743,596 on Aug. 18, 2020. The entirety of the aforementioned application is incorporated by reference herein.

TECHNICAL FIELD

Aspects herein relate to an insulated vented garment and methods for making an insulated vented garment.

BACKGROUND

Traditional ways of creating insulated garments comprise creating chambers through, for example, stitching panels of material together and blowing down or other synthetic fibers into the chambers. This often requires specialized machinery and can be messy. Moreover, traditional insulated garments may trap moisture vapor produced by the wearer which may result in wearer discomfort.

BRIEF DESCRIPTION OF THE DRAWINGS

Examples of the present invention are described in detail below with reference to the attached drawing figures, wherein.

DETAILED DESCRIPTION

Figure 1:
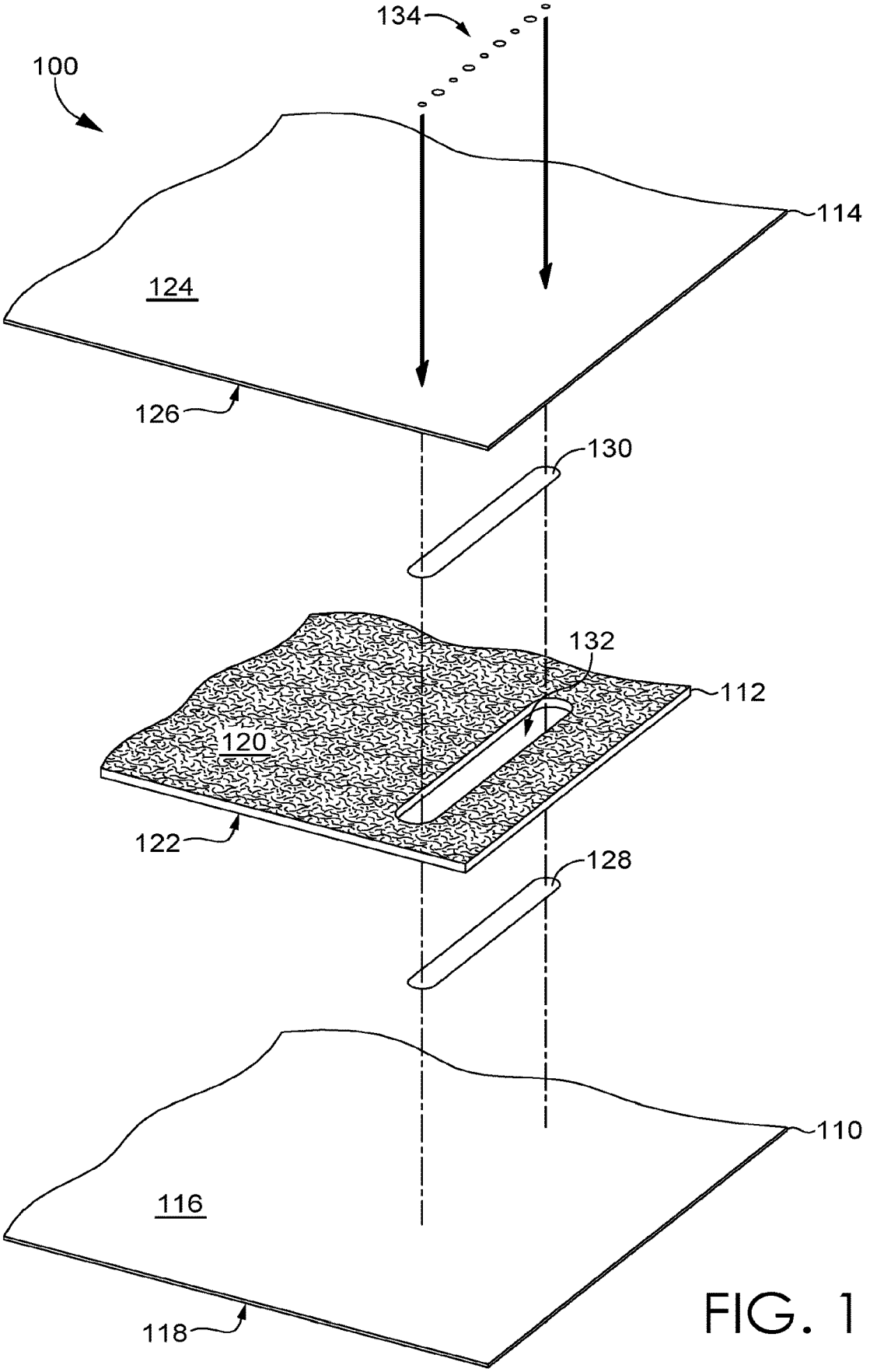
FIG. 1 illustrates an exploded view of a first exemplary construction for an insulated vented garment in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to methods of constructing insulated vented garments and garments resulting therefrom. Methods of constructing the insulated vented garment may utilize non-woven polymer sheets or sections of non-woven polymer material instead of materials such as down or loose poly-fill fibers. As used throughout this disclosure, terms such as "non-woven polymer sheet," "poly-fill sheet," "thermally insulating sheet material," and "thermally insulating fill sheet" may be used interchangeably herein. Further, as used throughout this disclosure, terms such as "sections of non-woven polymer material," "sections of poly-fill material," "sections of thermally insulating sheet material," and "sections of thermally insulating fill material" may be used interchangeably herein. Besides being easier to work with due to their cohesive structure, the use of non-woven polymer sheets or sections of non-woven polymer material imparts warmth to the finished garment. Moreover, the non-woven polymer materials described herein are generally hypoallergenic, do not require special laundering, have short dry times, and still provide warmth even when wet. They also do not require specialized handling or machinery when forming the garment which saves on manufacturing costs.

In a first method of construction that utilizes non-woven polymer sheets, one or more selected portions of the non-woven polymer sheet may be removed to create openings or voided portions in the non-woven polymer sheet. In an alternative aspect, the non-woven polymer may be formed to have one or more openings or voided portions. The non-woven polymer sheet is positioned between a first and second panel of material. The first panel of material is secured or bonded to the second panel of material in one or more areas corresponding to the voided portions in the non-woven polymer sheet. In an optional exemplary aspect, one or more perforations may be formed in the bonded areas where the perforations extend through the first panel of material and the second panel of material. As described further below, the perforations may be useful for allowing moisture vapor and/or excess heat produced by a wearer to escape from inside of the garment. The first and second panels of material may be used at least in part to form the garment.

Garments produced using the first method may comprise, for instance, at least one garment panel having an inner panel and an outer panel. A non-woven polymer sheet may be positioned between the inner and outer panels where the non-woven polymer sheet may comprise a voided portion (i.e., a portion from which the non-woven polymer sheet material has been removed or is absent). The garment may further comprise at least one seam that joins the inner panel to the outer panel at an area corresponding to the voided portion of the non-woven polymer sheet. In aspects, the garment may comprise multiple seams at areas corresponding to voided portions of the non-woven polymer sheet where the seams may help to define a plurality of chambers containing the non-woven polymer sheet. In an optional aspect, the garment may further comprise one or more perforations located on the seam, where the perforations extend through the inner panel and the outer panel.

In a second method of construction that utilizes sections or strips of non-woven polymer material, the section of non-woven polymer material may be positioned between a first and second panel of material. The first panel of material may be secured or bonded to the second panel of material in one or more areas adjacent to the section of non-woven polymer material. In an optional exemplary aspect, perforations may be formed in the bonded area where the perforations extend through the first panel of material and the second panel of material.

Garments produced using the second method of construction may comprise, for example, at least one garment panel having an inner panel and an outer panel. A section of non-woven polymer material may be positioned between the inner panel and the outer panel. The garment may further comprise one or more seams that join the inner panel to the outer panel at areas immediately adjacent or next to the section of non-woven polymer material; the seams may define a chamber that contains the section of non-woven polymer material. In an optional aspect, perforations may extend through the seam(s) such that they extend through the inner panel and the outer panel.

In general, garments produced using the first and second methods of construction are both insulating and breathable. This may be advantageous for a wearer undergoing physical exertion as these wearers often produce moisture in the form of perspiration. Perspiration still occurs in cold weather and may increase when the wearer is wearing a heat-insulating garment. By utilizing the perforations as described herein, the moisture vapor may escape to the exterior environment helping to keep the wearer comfortable. As well, the interior temperature of the garment may be regulated by facilitating a transfer of heat through the garment via the perforations.

Additional advantages may be obtained by using non-woven polymer sheets and/or sections of non-woven polymer material. Because of their non-woven structure formed, for example, by entangling fibers or filaments, they are able to maintain a cohesive or unitary structure as opposed to, for instance, loose poly-fill fibers and/or down. As such, they allow for the creation of chambers that are positioned vertically and/or diagonally on a garment. In other words, because there is little risk of drift of the materials (as opposed to, for example, down and/or loose poly-fill fibers that do not have a cohesive structure), the chambers may assume orientations other than generally discrete chambers having horizontal orientations. Further, the chambers can assume more organic or curvilinear shapes because there is no need to blow down or loose poly-fill fibers into the chambers. It is known that it is often difficult to evenly distribute down or loose poly-fill fibers into chambers that are curvilinear or that deviate from a more traditional horizontally oriented chamber. Additionally, since there is no need to contain loose fill materials, the chambers described herein may be in the form of "open-ended" chambers. That is, instead of a traditional chamber that is defined on all sides by seam lines to create an enclosed chamber, chambers described herein may comprise one or more sides or regions that are not bounded by seam lines.

Accordingly, aspects herein provide for a method of making an insulating garment, the method comprising providing a first panel of material; providing a second panel of material; and providing a thermally insulating fill sheet having one or more voided portions. The thermally insulating fill sheet is secured to at least the first panel of material, and the second panel of material is positioned such that the thermally insulating fill sheet is interposed between the first panel of material and the second panel of material. The first panel of material is affixed to the second panel of material in one or more areas corresponding to the one or more voided portions in the thermally insulating fill sheet and the garment is formed using at least the first panel of material and the second panel of material.

In another aspect, a garment is provided comprising at least a first garment panel. The first garment panel comprises an inner panel, an outer panel, and a thermally insulating fill sheet interposed between the inner panel and the outer panel, where the thermally insulating fill sheet comprising at least one voided portion. The garment further comprises at least one seam that joins the inner panel to the outer panel at an area corresponding to the voided portion of the thermally insulating fill sheet and a plurality of perforations located on the at least one seam, where the plurality of perforations extend through the at least one seam and through the inner panel and the outer panel.

In yet another aspect, a garment is provided comprising at least a first garment panel. The first garment panel comprises an inner panel, an outer panel, and a thermally insulating fill sheet interposed between the inner panel and the outer panel at a first area, where the thermally insulating fill sheet comprises at least a first voided portion and a second voided portion. The garment further comprises at least a first seam that joins the inner panel to the outer panel at a first location corresponding to the first voided portion of the thermally insulating fill sheet and at least a second seam that joins the inner panel to the outer panel at a second location corresponding to the second voided portion of the thermally insulating fill sheet, where the first seam is spaced apart from and unconnected to the second seam. Additionally the garment comprises an open-ended chamber formed between the inner panel and the outer panel and defined by the first seam and the second seam, where the chamber contains at least a portion of the thermally insulating fill sheet.

Aspects herein further provide for a method of making an insulated garment. The method comprises providing a first panel of material, providing a second panel of material, and providing a section of thermally insulating fill material. The section of thermally insulating fill material is positioned on the first panel of material and the second panel of material is positioned such that the section of thermally insulating fill material is interposed between the first panel of material and the second panel of material. The first panel of material is secured to the second panel of material at one or more areas adjacent to the section of thermally insulating fill material and the garment is formed using at least the first panel of material and the second panel of material.

In another aspect a garment is provided. The garment comprises at least a first garment panel comprising an inner panel, an outer panel, a first section of thermally insulating fill material interposed between the inner panel and the outer panel, and at least a first seam that joins the inner panel to the outer panel at a first area adjacent to the section of thermally insulating fill material.

In an additional aspect a garment is provided. The garment comprises at least a first panel of material comprising an inner panel, an outer panel, and a section of thermally insulating fill material interposed between the inner panel and the outer panel. The garment further comprises a first seam that joins the inner panel to the outer panel at a first area adjacent to the section of thermally insulating fill material and a second seam that joins the inner panel to the outer panel at a second area adjacent to the section of thermally insulating fill material. The first seam and the second seam define an open-ended chamber containing the section of thermally insulating fill material.

As used throughout this disclosure, positional terms used when describing, for instance, a garment, such as "anterior," "posterior," "inferior," "superior," "lateral," "medial," and the like are to be given their common meaning with respect to the garment being worn by a hypothetical wearer standing in anatomical position. Unless indicated otherwise, terms such as "affixed," "coupled," "secured," and the like may mean releasably affixing two or more elements together using for instance, structural differences between the elements, releasable adhesives, snaps, buttons, hook-and-loop fasteners, and the like. These terms may also mean permanently affixing two or more elements together using, for example, stitching, bonding, adhesives, welding, and the like. Unless indicated otherwise, terms such as "proximate" or "adjacent" may mean within 0 cm to 5.0 cm of a designated reference point.

First Exemplary Method of Construction and Garments Produced Therefrom

Aspects herein contemplate a method of forming an insulated vented garment using non-woven polymer sheets such as a thermally insulating poly-fill sheet. Aspects herein further contemplate an insulated vented garment formed using non-woven polymer sheets. As used throughout this disclosure the term "non-woven" may be defined as a mat or sheet-like structure formed by entangling fibers or filaments of a material. In exemplary aspects, the non-woven polymer sheet may comprise a single layer or multiple layers. Further, in exemplary aspects, the polymer material may comprise polyester fibers or filaments. The non-woven polymer sheet is generally lightweight but provides good insulation due to heated air being trapped between the entangled fibers.

Turning now to FIG. 1, an exploded view of a first exemplary construction 100 for an insulated vented garment is provided in accordance with aspects herein. The exemplary construction 100 comprises at least a first pliable textile layer 110, a non-woven polymer sheet 112, and a second pliable textile layer 114. In aspects, the first textile layer 110 may comprise an inner-facing layer of the garment (i.e., the layer configured to face toward a body surface of a wearer when the garment is worn), and the second textile layer 114 may comprise an outer-facing layer of the garment (i.e., the layer configured to face away from a body surface of a wearer and toward the external environment when the garment is worn). The first textile layer may comprise a first surface 116 and an opposite-facing second surface 118, where the second surface 118 is configured to face toward the body surface of the wearer when the garment is worn. The second textile layer 114 may comprise a third surface 124 and an opposite-facing fourth surface 126, where the third surface 124 is configured to face toward the external environment when the garment is worn.

In exemplary aspects, the first textile layer 110 and the second textile layer 114 may comprise a knitted, woven, or non-woven textile. Further, the first textile layer 110 may be formed of the same material (e.g., knit or woven material) as the second textile layer 114, or the layers 110 and 114 may be formed of different materials (i.e., the first textile layer 110 may be a knit material and the second textile layer 114 may be a woven material or vice versa). In exemplary aspects, one or more of the layers 110 and/or 114 may be treated with a durable water repellant (DWR) to make the resulting garment substantially impervious to water. For instance, the second textile layer 114, since it is an outer-facing layer, may be treated with a DWR finish. Further, it is contemplated herein that first textile layer 110 may be finished to provide a soft feel or hand to heighten wearer comfort since the first textile layer 100 is configured to potentially come into contact with the body surface of the wearer when the garment is worn. For instance, the first textile layer 110 may be brushed to impart a soft feel to the first textile layer 110. Any and all aspects, and any variation thereof, are contemplated as being within aspects herein.

It is further contemplated herein that one or more of the first textile layer 110 and/or the second textile layer 114 may be formed from fabrics having different weights. For instance, the layers 110 and/or 114 may be formed of light fabrics (89 $g/m^2$ to 30 $g/m^2$) or even ultra-light fabrics (29 $g/m^2$ or lighter). However, it is contemplated herein that heavier fabrics, such as fabrics with weights in the range of 90 $g/m^2$ to 149 $g/m^2$ or even 150 $g/m^2$ to 250 $g/m^2$ or higher may be used for the layers 110 and/or 114 in accordance with aspects herein.

The non-woven polymer sheet 112 is shown as being positioned between the first textile layer 110 and the second textile layer 114. It is contemplated herein that the non-woven polymer sheet 112 may comprise any number of different weights. Continuing, the non-woven polymer sheet 112 comprises a fifth surface 120 and an opposite-facing sixth surface 122. The fifth surface 120 is positioned adjacent to the fourth surface 126 of the second textile layer 114 in the construction 100, and the sixth surface 122 is positioned adjacent to the first surface 116 of the first textile layer 110 in the construction 100.

The non-woven polymer sheet 112 is shown with a portion removed to form an opening or a voided portion 132. In exemplary aspects, this may be done using a mechanical cutting process, ultrasonic cutting, laser cutting, water jet cutting, and the like to form the voided portion 132 in the non-woven polymer sheet 112. In an alternative exemplary aspect, the non-woven polymer sheet 112 may be pre-formed to have the voided portion 132. Any and all aspects, and any variation thereof, are contemplated as being within aspects herein. Although shown with just one voided portion 132, it is contemplated herein that the non-woven polymer sheet 112 may comprise multiple voided portions. Further, it is contemplated herein, that the voided portion 132 may comprise any number of different lengths and may have different shapes such as curvilinear or organic shapes. Any and all aspects, and any variation thereof, are contemplated as being within aspects herein.

The construction 100 depicted in FIG. 1 further comprises a first adhesive material 128 and a second adhesive material 130. In exemplary aspects, the first adhesive material 128 and the second adhesive material 130 may comprise an adhesive tape formed to have a shape corresponding to that of the voided portion 132 of the non-woven polymer sheet 112. The first adhesive material 128 and the second adhesive material 130 may be used to secure or bond the first textile layer 110 to the second textile layer 114 at the voided portion 132 of the non-woven polymer sheet 112. For instance, the first adhesive material 128 may be positioned on the first textile layer 110 and the non-woven polymer sheet 112 may be positioned on the first textile layer 110 such that the voided portion 132 is axially aligned with the first adhesive material 128. The second adhesive material 130 may also be positioned such that it is axially aligned with the voided portion 132, and the second textile layer 114 may be positioned adjacent to the first textile layer 110. Then, the two layers 110 and 114 may be pressed together with sufficient force and/or energy applied in an area generally corresponding to the voided portion 132 to activate the adhesive materials 128 and 130 to create a bond(s) between the two layers 110 and 114. The adhesive materials 128 and 130 may be activated by, for instance, heat, or ultrasonic energy, or any other type of applied energy. By removing portions of the non-woven polymer sheet 112 at areas where the first and second textile layers 110 and 114 are bonded, a more secure bond may be formed.

Once the first textile layer 110 and the second textile layer 114 are bonded together, a seam is formed at the bonded area. In other words, a seam is formed at the voided portion 132 of the non-woven polymer sheet 112 as will be discussed further below. It is contemplated herein, that only one of the adhesive materials 128 or 130 may be used herein to affix the first textile layer 110 to the second textile layer 114. Any and all aspects, and any variation thereof, are contemplated as being within aspects herein.

The construction 100 further comprises one or more optional perforations 134. In exemplary aspects, the perforations 134 are made through the second textile layer 114 and the first textile layer 110 in the area corresponding to the voided portion 132. To put it another way, the perforations 134 are formed at the seam area created when the first textile layer 110 is affixed or bonded to the second textile layer 114 at the voided portion 132 of the non-woven polymer sheet 112. The perforations 134 may be formed using, for instance, a mechanical cutting process, a knitting or weaving process, laser cutting, water jet cutting, ultrasonic cutting, and the like. As stated above, the perforations 134 may be used to allow moisture vapor or excess heat produced by the wearer to exit the garment.

Figure 2:
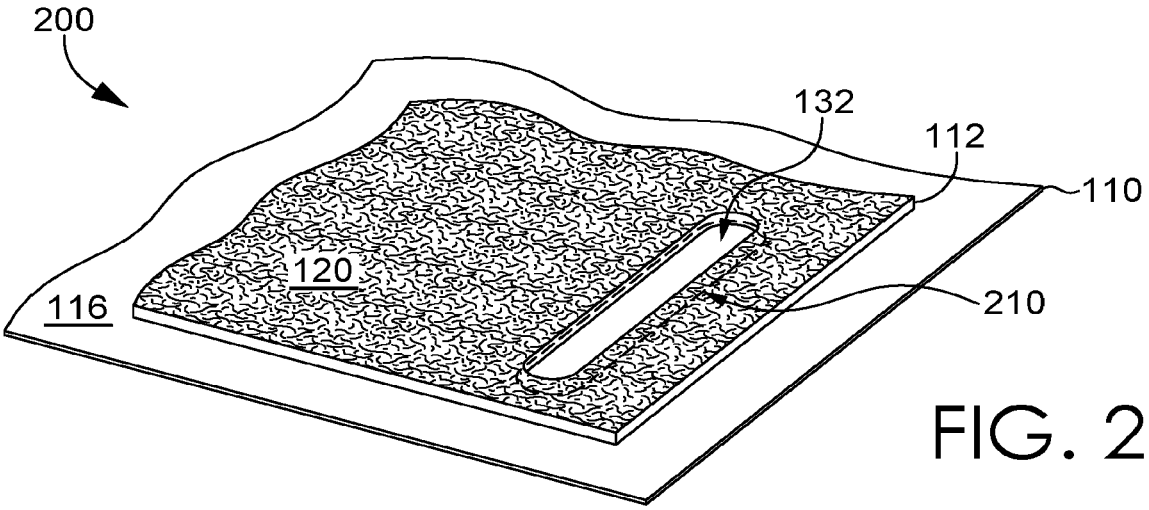
FIG. 2 illustrates a top perspective view of a construction detail for the first exemplary construction of FIG. 1 in accordance with aspects herein.

Turning now to FIG. 2, referenced generally by the numeral 200, a top perspective view of a portion of the construction 100 is shown comprising the non-woven polymer sheet 112 positioned on the first surface 116 of the first textile layer 110 in accordance with aspects herein. Before affixing the first textile layer 110 to the second textile layer 114 at the voided portion 132 of the non-woven polymer sheet 112 as described above, the non-woven polymer sheet 112 may be secured to the first textile layer 110 to prevent shifting of the non-woven polymer sheet 112 during manipulation of the construction 100. For example, the non-woven polymer sheet 112 may be secured to the first textile layer 110 by stitching or tacking a perimeter edge defining the voided portion 132 to the first textile layer 110. This is indicated by reference numeral 210. Other methods of securing the non-woven polymer sheet 112 to the first textile layer 110 are contemplated herein such as using adhesives, a bonding process, spot welding, a melting process, and the like. Moreover, although shown as secured to the first textile layer 110, it is contemplated herein that the non-woven polymer sheet 112 may alternatively be secured to the second textile layer 114 or to both the first textile layer 110 and the second textile layer 114.

Figure 3:
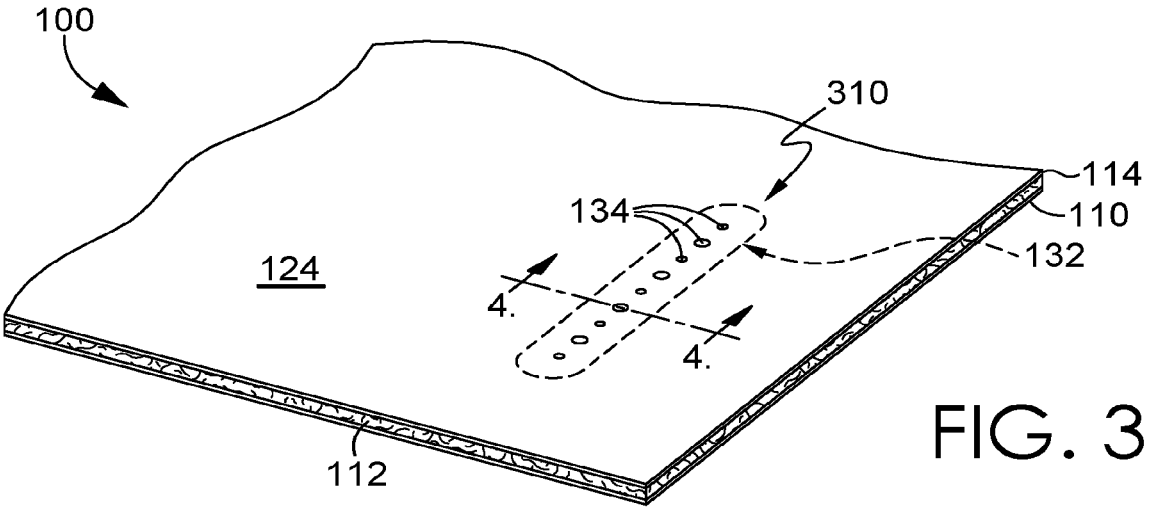
FIG. 3 illustrates a top perspective view of the first exemplary construction of FIG. 1 when in an as-assembled state in accordance with aspects herein.

FIG. 3 illustrates a top perspective view of the construction 100 in an as-assembled state in accordance with aspects herein. As shown, the second textile layer 114 is positioned adjacent to the first textile layer 110 such that the third surface 124 of the second textile layer 114 is exposed. The non-woven polymer sheet 112 is positioned between the first textile layer 110 and the second textile layer 114. The voided portion 132 of the non-woven polymer sheet 112 is indicated by the dashed lines. As described above, the first textile layer 110 is secured or bonded to the second textile layer 114 at the voided portion 132 to form a seam 310. The perforations 134 extend through the seam 310. In other words, the perforations 134 extend through the first textile layer 110 and the second textile layer 114 at the seam 310 in accordance with aspects herein.

Figure 4:
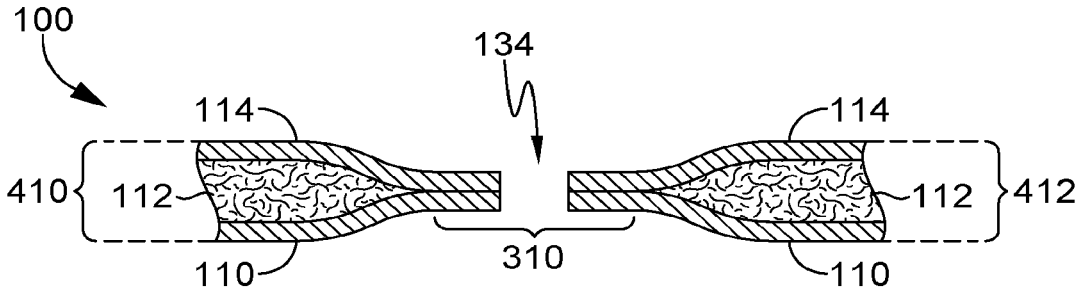
FIG. 4 illustrates a cross-sectional view taken along cut line 4-4 of FIG. 3 in accordance with aspects herein.

A cross-section of the construction 100 taken along cut line 4-4 of FIG. 3 is shown in FIG. 4 in accordance with aspects herein. Because the seam 310 is positioned at a location corresponding to the voided portion 132 of the non-woven polymer sheet 112, the non-woven polymer sheet 112 is not present in the seam 310. However, all three layers—the first textile layer 110, the non-woven polymer sheet 112, and the second textile layer 114—are present in the areas adjacent to the seam 310. As further shown in FIG. 4, the perforations 134 extend through the first textile layer 110 and the second textile layer 114 at the seam 310. As used throughout this disclosure, portions of the construction 100 that comprise the first textile layer 110, the non-woven polymer sheet 112, and the second textile layer 114 may be known as chambers. For instance, the reference numeral 410 may indicate a first chamber and the reference numeral 412 may indicate a second chamber, where the first chamber 410 may be demarcated or separated from the second chamber 412 by the seam 310.

Figure 5:
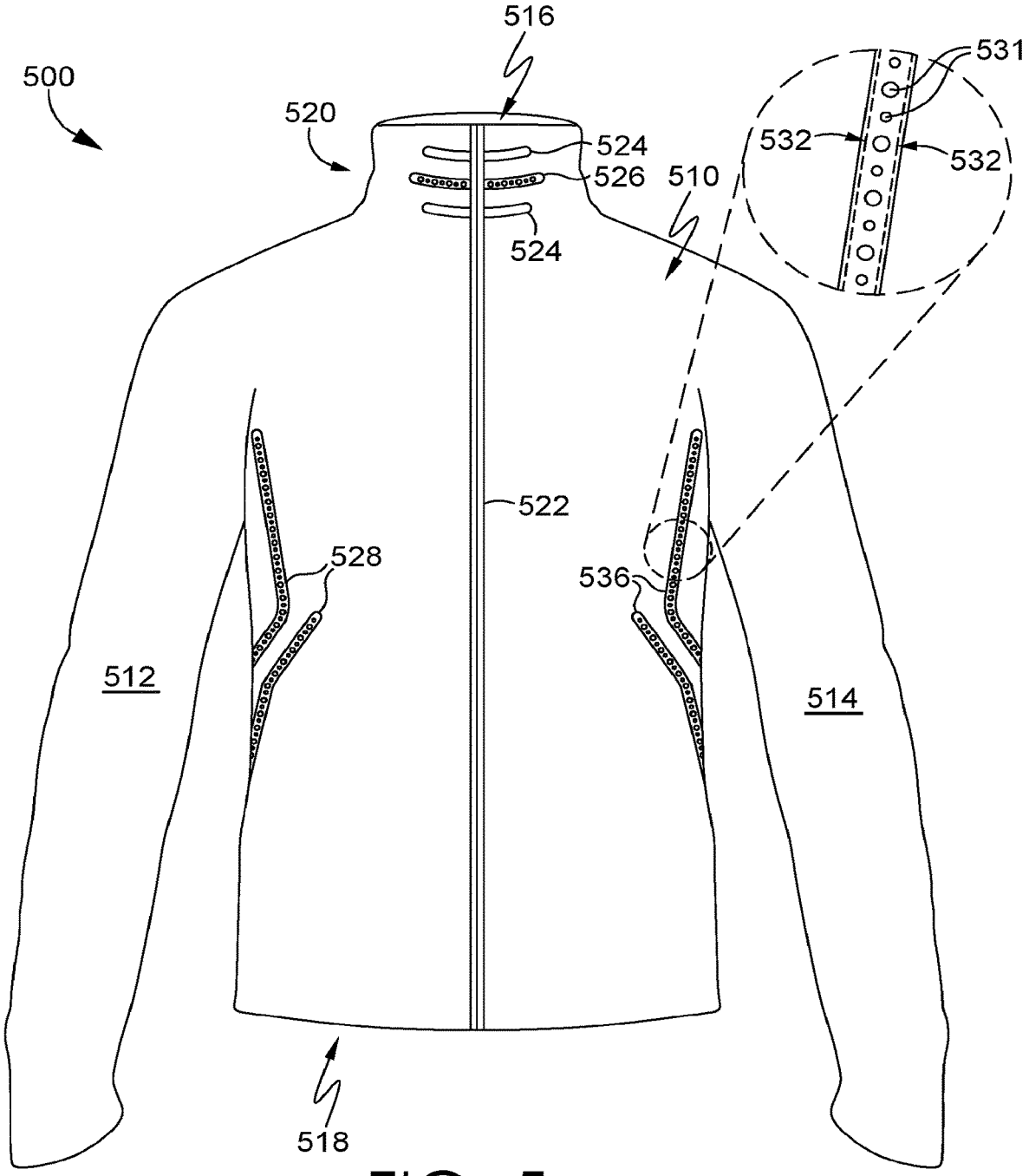
FIGS. 5-6 illustrate front and back views respectively of an exemplary insulated vented garment formed using, or instance, the first exemplary construction of FIG. 1 in accordance with aspects herein.
Figure 6:
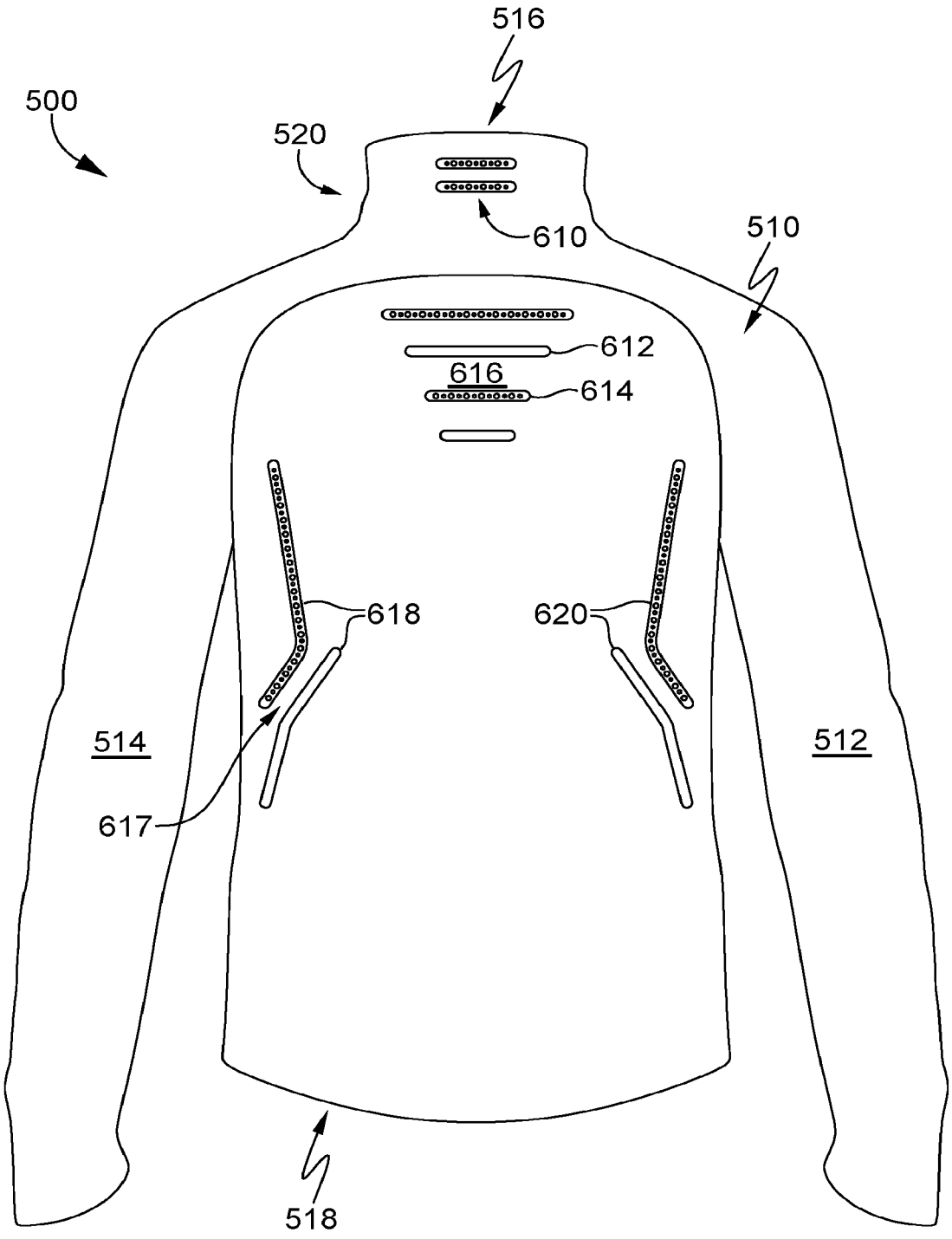

Turning now to FIGS. 5 and 6, front and back views respectively of a garment 500 having the construction 100 is shown in accordance with aspects herein. The garment 500 is shown in the form of a jacket although it is contemplated herein that the garment 500 may take other forms such as a shirt, a pull-over hoodie, a vest, a pant, a short, a body suit, a sock, a hat, a shoe, and the like. The garment 500 comprises a torso portion 510 configured to cover the front and back torso of a wearer when the garment 500 is in an as-worn configuration. The torso portion 510 may comprise an optional releasable fastener mechanism 522 such as a zipper used to open and close the garment 500. The torso portion 510 defines at least a neck opening 516, a waist opening 518, and first and second sleeve openings (not shown). The neck opening 516, in turn, may be defined by a collar portion 520 of the garment 500. The garment may optionally comprise a first sleeve portion 512 extending from the torso portion 510 at the first sleeve opening, and a second sleeve portion 514 extending from the torso portion 510 at the second sleeve opening.

Some or all of the garment 500 may comprise the construction 100 described with respect to FIGS. 1-4. For instance, it is contemplated herein that an entirety of the torso portion 510 including the collar portion 520 may be formed of the construction 100. In some aspects, the first and second sleeve portions 512 and 514 may also be formed from the construction 100.

It is also contemplated herein that the construction 100 may be used on only portions of the garment 500. For instance, the garment 500 may be zoned into different areas such as areas needing a high amount of insulation, a moderate amount of insulation, and areas needing a low amount of insulation. In exemplary aspects, the zoning may be based on heat or sweat maps of the human body. Areas needing a high amount of insulation may comprise, for instance, the first and second sleeve portions 512 and 514. Areas needing a moderate to high amount of insulation may comprise, for instance, the front of the torso portion 510, and areas needing a moderate to low amount of insulation may comprise, for example, the back of the torso portion 510. These locations are exemplary only and it is contemplated herein that the garment 500 may be zoned differently.

Continuing, areas needing a high amount of insulation may be formed from the construction 100 but the non-woven polymer sheet 112 in these areas may not comprise voided portions. Instead, a continuous expanse of the non-woven polymer sheet 112 may be positioned between the first and second textiles layers 110 and 114 to provide a higher level of insulation. As such, it is contemplated herein that areas needing higher insulation may not comprise seams, such as the seam 310, and may not comprise perforations such as the perforations 134.

Areas needing a moderate amount of insulation may be formed from the construction 100 where the non-woven polymer sheet 112 comprises the voided portions and the first and second textile layers 110 and 114 are bonded together at locations corresponding to the voided portions to create one or more seams. By having voided portions in these areas, a lower amount of insulation may be achieved as compared to having a continuous expanse of non-woven polymer sheet. Perforations, such as the perforations 134 may be formed on some or all of the seams to impart increased permeability and breathability to the garment 500 in these areas.

Areas needing a low amount of insulation may also be formed from the construction 100. In exemplary aspects, an increased number of seams may be formed in these areas, and/or a greater number of seams may comprise perforations for a higher level of permeability and breathability. Alternatively, areas needing a low amount of insulation may be formed without using the construction 100. For instance, these areas may not comprise the non-woven polymer sheet 112 and instead may comprise just the first and second textile layers 110 and 114, just one of the layers 110 or 114, or the areas may comprise a different textile such as, for instance, a mesh material for greater permeability and breathability. Any and all aspects, and any variation thereof, are contemplated as being within aspects herein.

Referring particularly to the garment 500 shown in FIG. 5, the garment 500 comprises a number of seams where the seams represent areas where the first textile layer 110 is bonded or secured to the second textile layer 114 at voided portions in the non-woven polymer sheet 112. For instance, seams 528 may be located on a front aspect of the torso portion 510 at a first lateral side of the torso portion 510, seams 536 may be located on the front aspect of the torso portion 510 at a second opposite lateral side of the torso portion 510, and seams 524 and 526 may be located on the front aspect of the collar portion 520. Although the seams 526, 528, and 536 are shown as being perforated, it is contemplated herein that one or more of the seams 526, 528, and 536 may not be perforated.

A close-up of perforations 531 located on the seams 536 is shown in FIG. 5. In exemplary aspects, the perforations 531 may comprise a number of different shapes and sizes. As shown, the perforations 531 may comprise an alternating pattern of larger-sized perforations and smaller-sized perforations. Moreover, the perforations 531 may extend continuously along the seam 536 as shown, or the perforations 531 may be placed intermittently along the seam 536. As further shown in the close-up view of the seam 536, the seam 536 may optionally be reinforced with stitching 532. The stitching 532 may be along one edge of the seam 536 or along both edges of the seam 536. Any and all aspects, and any variation thereof, are contemplated as being within aspects herein.

The seams 524 and 526 on the collar portion 520 of the garment 500 comprise both perforated and unperforated seams. For instance, the seams 524 are unperforated and the seam 526 is perforated. Having both perforated and unperforated seams at the collar portion 520 may help provide a moderate amount of insulation while still imparting a breathable and permeable characteristic to the collar portion 520.

The back of the garment 500 as shown in FIG. 6 may comprise a different pattern of seams as compared to the front of the garment 500. For instance, seams 618 may be located at a first lateral side of the back of the torso portion 510, seams 620 may be located at a second opposite lateral side of the back of the torso portion 510, and an additional set of seams 612 and 614 may be located at an upper central back of the torso portion 510. Seams 610 may also be located on the collar portion 520. Similar to the seams located on the front of the torso portion 510, some or all of the seams 610, 612, 614, 618, or 620 may be perforated.

In exemplary aspects, open-ended chambers may be formed between adjacent seams. For instance, with respect to FIG. 6, an open-ended chamber 616 may be formed between the seam 612 and the seam 614. The chamber 616 is defined along two sides by the seams 612 and 614 but is undefined or open at each opposing end. The creation of open-ended chambers, such as the chamber 616 is possible due to the cohesive or unitary structure of the non-woven polymer sheet 112. In other words, because of its non-woven structure, the polymer sheet 112 does not have to be enclosed within, for example, a four-sided chamber as opposed to, for example, loose fill or down which may escape the chamber if not enclosed. Moreover, use of the non-woven polymer sheet 112 enables the creation of chambers, such as chamber 617 that is vertically or diagonally oriented on the garment 500. Using vertically or diagonally oriented chambers with, for example, loose fill or down may be challenging as these materials have a tendency to settle due to gravity.

The pattern of the seams shown on the front and back of the garment 500 are exemplary only, and it is contemplated herein that different seam patterns may be utilized in accordance with aspects herein. Moreover, it is contemplated that seams may be present on the sleeve portions 512 and 514 when the sleeve portions 512 and 514 are formed using the construction 100. The perforation patterns shown in association with the seams on the garment 500 are also exemplary, and it is contemplated herein that different perforation patterns may be utilized in accordance with aspects herein.

Any and all aspects, and any variation thereof, are contemplated as being within aspects herein.

Figure 7:
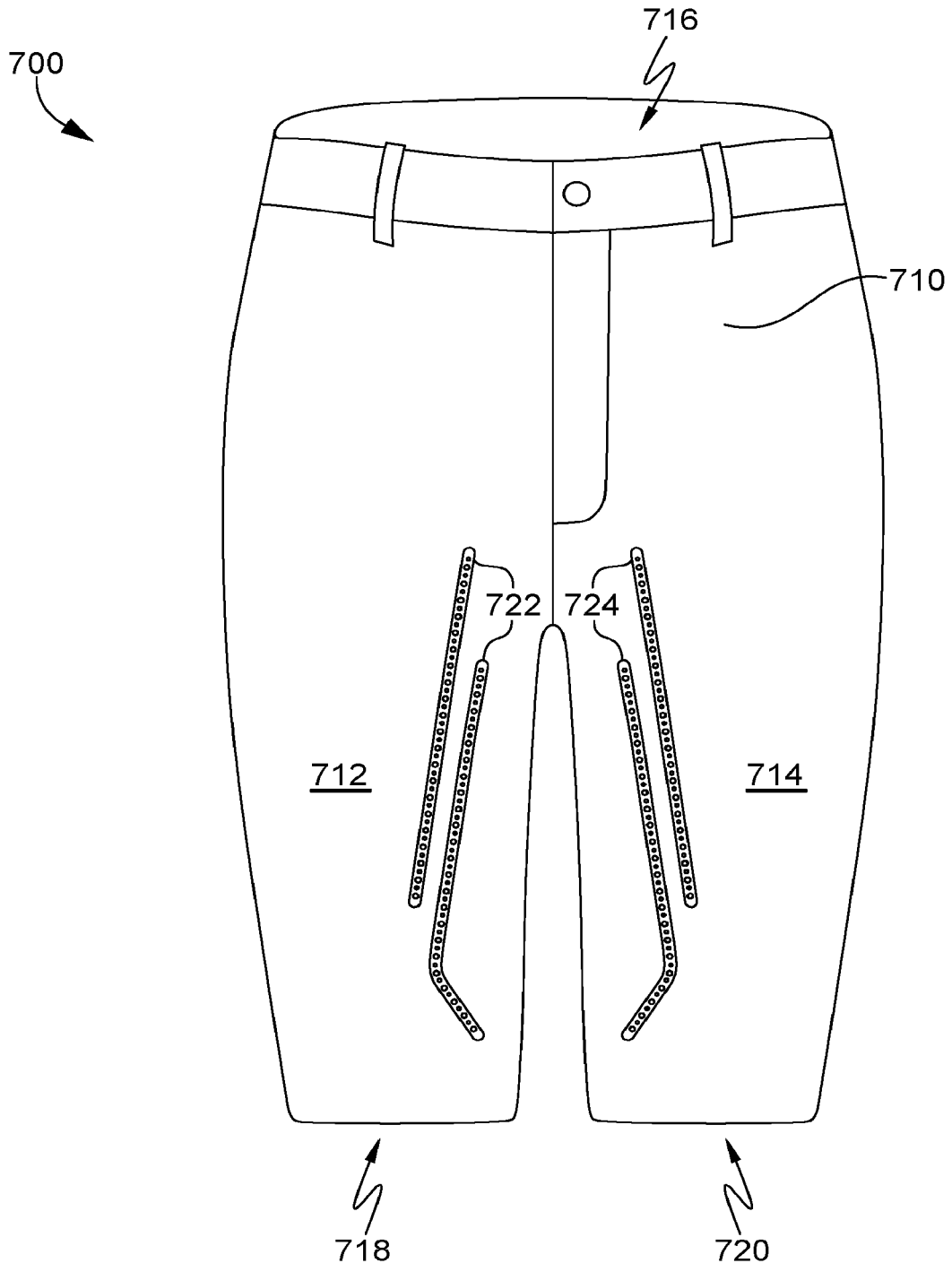
FIGS. 7-8 illustrate front and back views respectively of an exemplary insulated vented garment formed, for instance, using the first exemplary construction of FIG. 1 in accordance with aspects herein.
Figure 8:
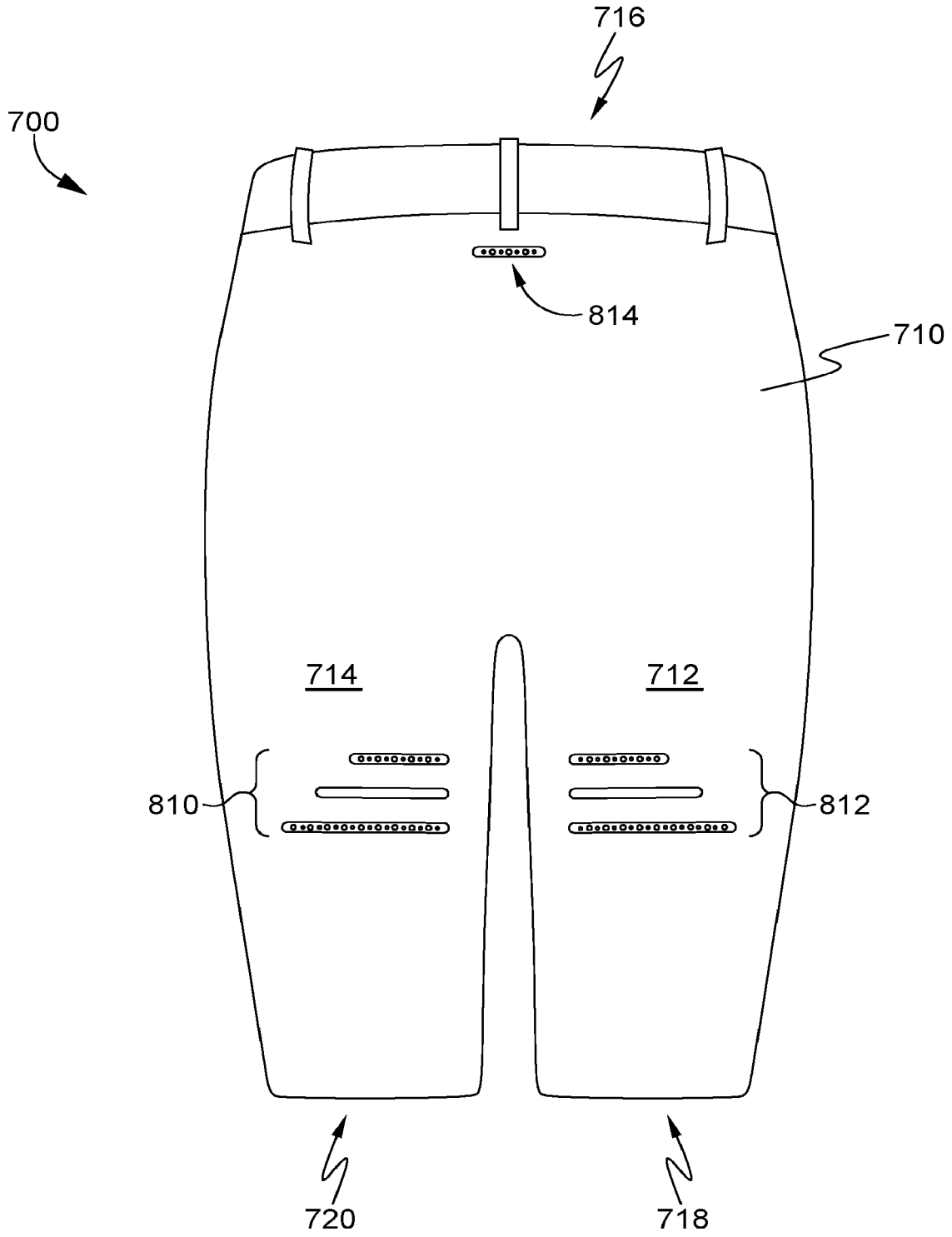

FIGS. 7 and 8 illustrate front and back views respectively of a garment 700 also formed using the construction 100 in accordance with aspects herein. The garment 700 is in the form of a short although it is contemplated herein that the garment 700 may be in the form of a pant, a three-quarter pant, a capri, a tight, and the like. The garment 700 comprises a torso portion 710 adapted to cover a lower torso of a wearer when the garment 700 is worn, a first leg portion 712, and a second leg portion 714. The torso portion 710 along with the first and second leg portions 712 and 714 help to define at least in part a waist opening 716, a first leg opening 718, and a second leg opening 720.

Similar to the garment 500, the garment 700 may be configured to provide varying levels of insulation over different portions of the garment 700. This may be based on heat or sweat maps of the human body. For instance, a greater amount of insulation may be needed in areas of the garment 700 adapted to cover the anterior thigh area of a wearer, and lower amounts of insulation may be needed over the back of the torso portion 710 of the garment 700. As such, the construction over different parts of the garment 700 may vary to include a non-woven polymer sheet without voided portions, a non-woven polymer sheet with voided portions, a non-woven polymer sheet with voided portions and perforations, and/or parts of the garment 700 that do not include a non-woven polymer sheet.

As stated, the garment 700 may be formed from the construction 100. As such, some or all of the garment 700 may comprise the first textile layer 110, the non-woven polymer sheet 112, and the second textile layer 114. One or more portions of the non-woven polymer sheet 112 may be removed to form voided portions, such as the voided portion 132 in FIG. 1. With respect to FIG. 7, seams 722 and 724 may be formed in areas corresponding to voided portions of the non-woven polymer sheet 112. In exemplary aspects, seams 722 may be located over a front aspect of the first leg portion 712, and seams 724 may be located over a front aspect of the second leg portion 714. Although the seams 722 and 724 are shown as comprising perforations, it is contemplated herein that one or more of the seams 722 and/or 724 may not comprise perforations. Both the seams 722 and 724 are shown in a near vertical orientation although other orientations are contemplated herein.

With respect to FIG. 8 which depicts a back view of the garment 700, the garment 700 may further comprise seams 810 located on a back aspect of the second leg portion 714 at a posterior knee region, and seams 812 located on a back aspect of the first leg portion 712 at a posterior knee region. Seam 814 may also be located on a posterior aspect of the torso portion 710 adjacent to the waist opening 716. As shown, some of the seams 810, 812, and 814 are perforated and some are not.

The placement and pattern of the seams on the garment 700 is exemplary only and other patterns are contemplated herein. Moreover, the perforation pattern shown for the garment 700 is exemplary only and other perforation patterns are contemplated herein. Any and all aspects, and any variation thereof, are contemplated as being within the scope herein.

Figure 9A:
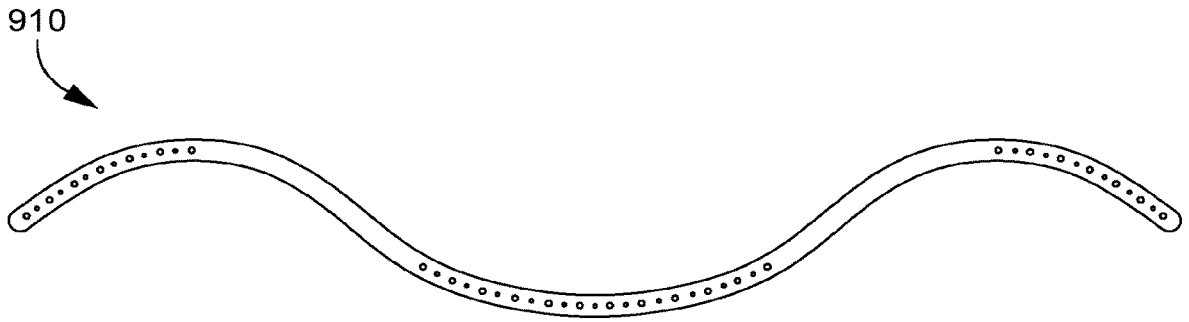
FIGS. 9A-9B illustrate exemplary patterns for a seam in accordance with aspects herein.
Figure 9B:
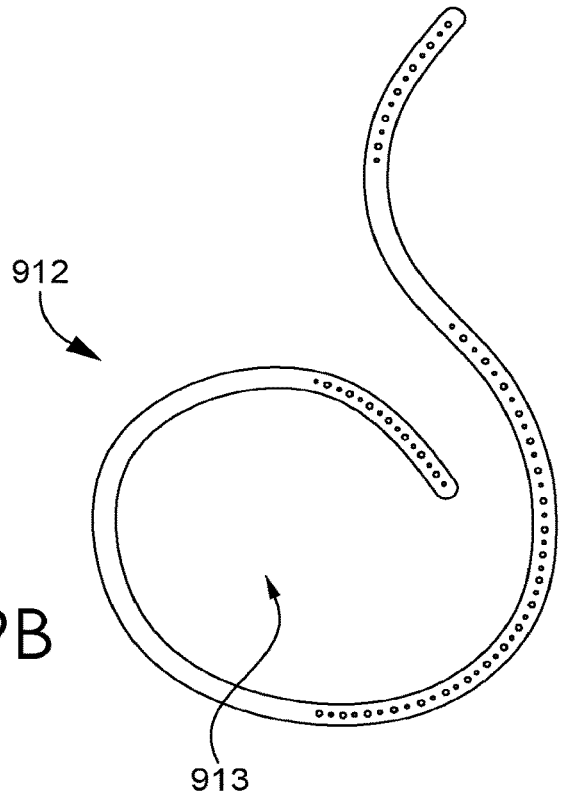

The seams shown for the garments 500 and 700 have generally been shown as being linear. However, it is contemplated that seams described herein may assume more organic or curvilinear shapes. FIGS. 9A and 9B illustrate this aspect. For instance, seam 910 in FIG. 9A comprises a wave-like form, and seam 912 in FIG. 9B comprise an almost circular component. The seam 912 may define at least in part a chamber 913. As seen, organic or curvilinear seam patterns may be used to define, for example, chambers that also have more organic or curvilinear shapes as compared to more traditional horizontally oriented, straight-edged chambers. In this aspect, the chamber 913 is defined by one seam line and may have one open end. FIGS. 9A and 9B further illustrate perforations located on the seams 910 and 912.

Figure 10:
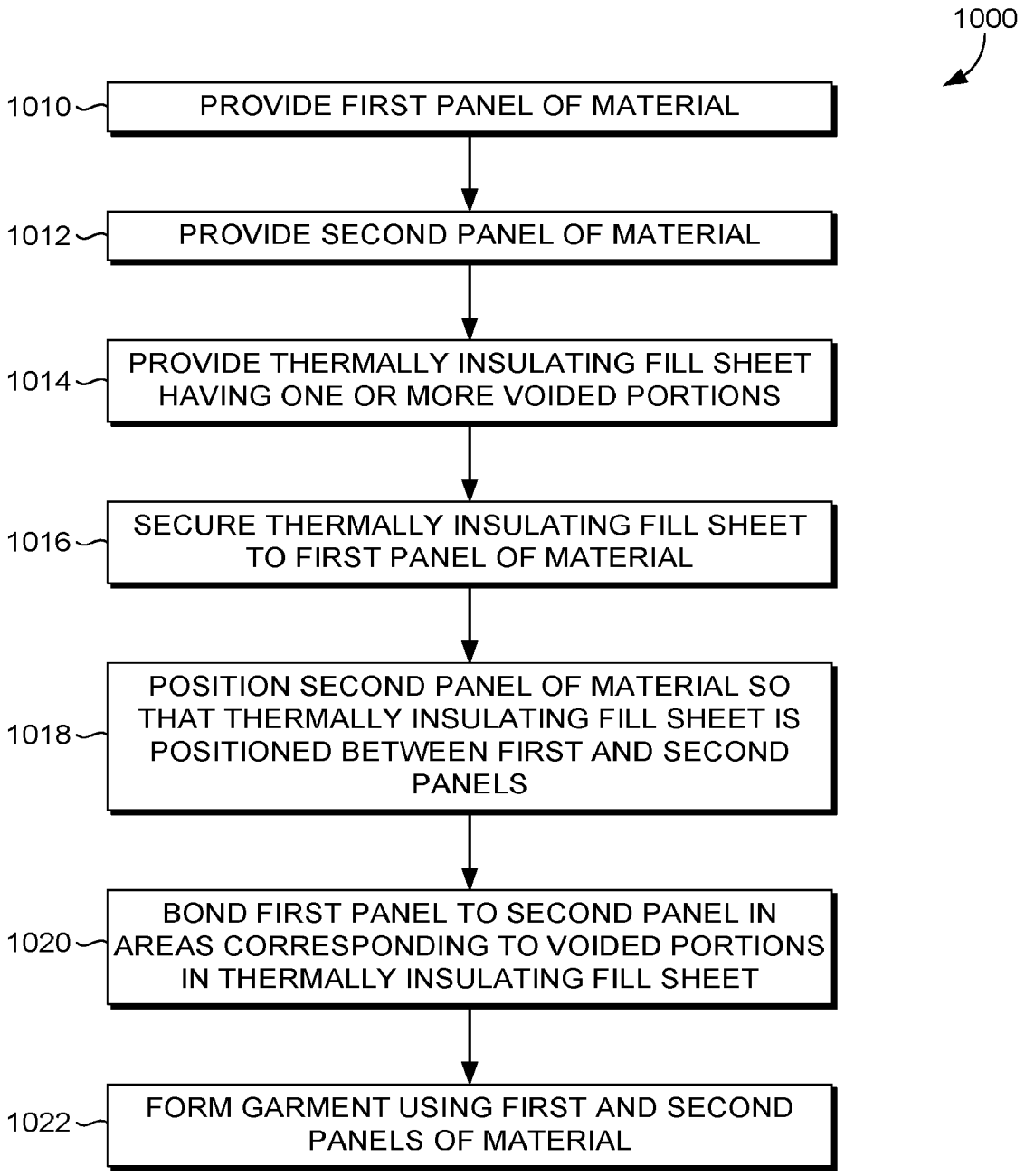
FIG. 10 illustrates a flow diagram of an exemplary method of forming an insulated vented garment in accordance with aspects herein.

Turning now to FIG. 10, a flow diagram depicting an exemplary method 1000 of forming an insulated vented garment using non-woven polymer sheets or thermally insulating fill sheets is provided in accordance with aspects herein. At a step 1010, a first panel of material, such as the first textile layer 110, is provided, and at a step 1012 a second panel of material, such as the second textile layer 114, is provided. In exemplary aspects, the first and second panels of material may comprise pliable knitted, woven, or non-woven textiles.

At a step 1014, a thermally insulating fill sheet such as the non-woven polymer sheet 112 is provided where the thermally insulating fill sheet comprises one or more voided portions or openings each defined by a perimeter edge. In one exemplary aspect, the voided portions may be formed by removing selected portions of the thermally insulating fill sheet using, for instance, a mechanical cutting process, laser jet cutting, water jet cutting, ultrasonic cutting, and the like. The portions removed from the thermally insulating fill sheet may be based on, for instance, a predetermined pattern. In an alternative exemplary aspect, the thermally insulating fill sheet may be pre-formed to have the voided portions.

At a step 1016, the thermally insulating fill sheet is secured to one or more of the first panel of material and/or the second panel of material. In exemplary aspects, this may occur by, for example, tacking or stitching the perimeter edge defining each of the openings or voided portions to the first and/or second panel of material. Other ways of securing the thermally insulating fill sheet to the first and/or second panels of material are contemplated herein such as using adhesives, bonding, spot welding, and the like.

At a step 1018, the first and second panels of material are positioned adjacent to each other such that the sheet of thermally insulating fill sheet is interposed between the first and second panels. At a step 1020, the first and second panels of material are secured to each other in areas corresponding to the openings or voided portions in the thermally insulating fill sheet to form seams. In exemplary aspects, this may occur by providing an adhesive material, such as an adhesive sheet, that is formed (e.g., cut) to have a shape corresponding to the shape of an opening in the thermally insulating fill sheet. The adhesive material is positioned between the first and second panels of material such that it is aligned with the respective opening or voided portion in the thermally insulating fill sheet. The adhesive material is activated by the application of, for example, heat, light, ultrasound, pressure, and the like in the area corresponding to the opening to bond the first panel of material to the second panel of material. A similar process is contemplated for each of the openings or voided portions formed in the thermally insulating fill sheet. At a step 1022, the garment is formed using at least the bonded assembly described above.

Additional method steps are contemplated herein. For instance, perforations may be formed through some or all of the seams to impart breathability characteristics to the garment in addition to the insulation characteristics provided by the use of the thermally insulating fill sheet. It is further contemplated herein that the seams formed in the areas corresponding to the openings or voided portions in the thermally insulating fill sheet may be reinforced with stitching. The listing of the method steps 1000 is exemplary only, and it is contemplated herein that the steps may take place in other orders unless specified otherwise.

Another exemplary method of construction contemplated herein comprises using non-woven polymer sheets that do not have voided portions. In other words, the non-woven polymer sheets comprise continuous expanses without openings or voided portions formed therein. The non-woven polymer sheet is positioned between a first and second textile layer such as the first and second textile layers 110 and 114 of FIG. 1. However, instead of bonding the first and second layers directly together at the voided portions of the non-woven polymer sheet as described with respect to the construction 100, the first and second textile layers as well as the non-woven polymer sheet are bonded together in one or more areas to form seams. With respect to this aspect, material for the non-woven polymer sheet may be selected such that it melts and/or acts as an adhesive when activated via, for instance, heat or the application of energy. It is further contemplated herein that additional adhesive materials may be used to further augment the bond between the first and second textile layers and the non-woven polymer sheet. Thus, in this aspect, a seam area would comprise the first textile layer, the non-woven polymer sheet, and the second textile layer. Any and all aspects, and any variation thereof, are contemplated as being within aspects herein.

As described, aspects herein are directed to a method of forming an insulated vented garment using non-woven polymer sheets such as a thermally insulating poly-fill sheet. Aspects herein are further directed to an insulated vented garment formed using non-woven polymer sheets. The use of non-woven polymer sheets provides an economical and efficient production method, and garments produced using this type of construction may comprise organically shaped or curvilinear chambers that can be positioned on the garment to provide targeted insulation and venting features.

Second Exemplary Method of Construction and Garment Produced Therefrom

Aspects herein further contemplate a method of forming an insulated vented garment using sections or strips of a non-woven polymer material. Aspects herein also contemplate an insulated vented garment formed using sections or strips of non-woven polymer material. As used throughout this disclosure, the term "strips" or "sections" of non-woven polymer material may be defined as disparate or non-continuous portions of a non-woven polymer material that are used in the construction of a garment where adjacent disparate sections of non-woven polymer material may be separated by a seam as described below. In some aspects, the section may take the form of a narrow piece of non-woven polymer material (e.g., a piece whose width is less than its length) which is hereinafter known as a "strip" of non-woven polymer material. However, it is contemplated herein that the term "section" may also encompass other geometries such as square pieces of non-woven polymer material, rectangular pieces of non-woven polymer material, circular or triangular pieces of non-woven polymer material, curvilinear or organically shaped pieces of non-woven polymer material, and the like. Similar to above, the sections of non-woven polymer material, when incorporated into a garment, may provide good insulation due to heated air being trapped between the entangled fibers while still being lightweight.

Figure 11:
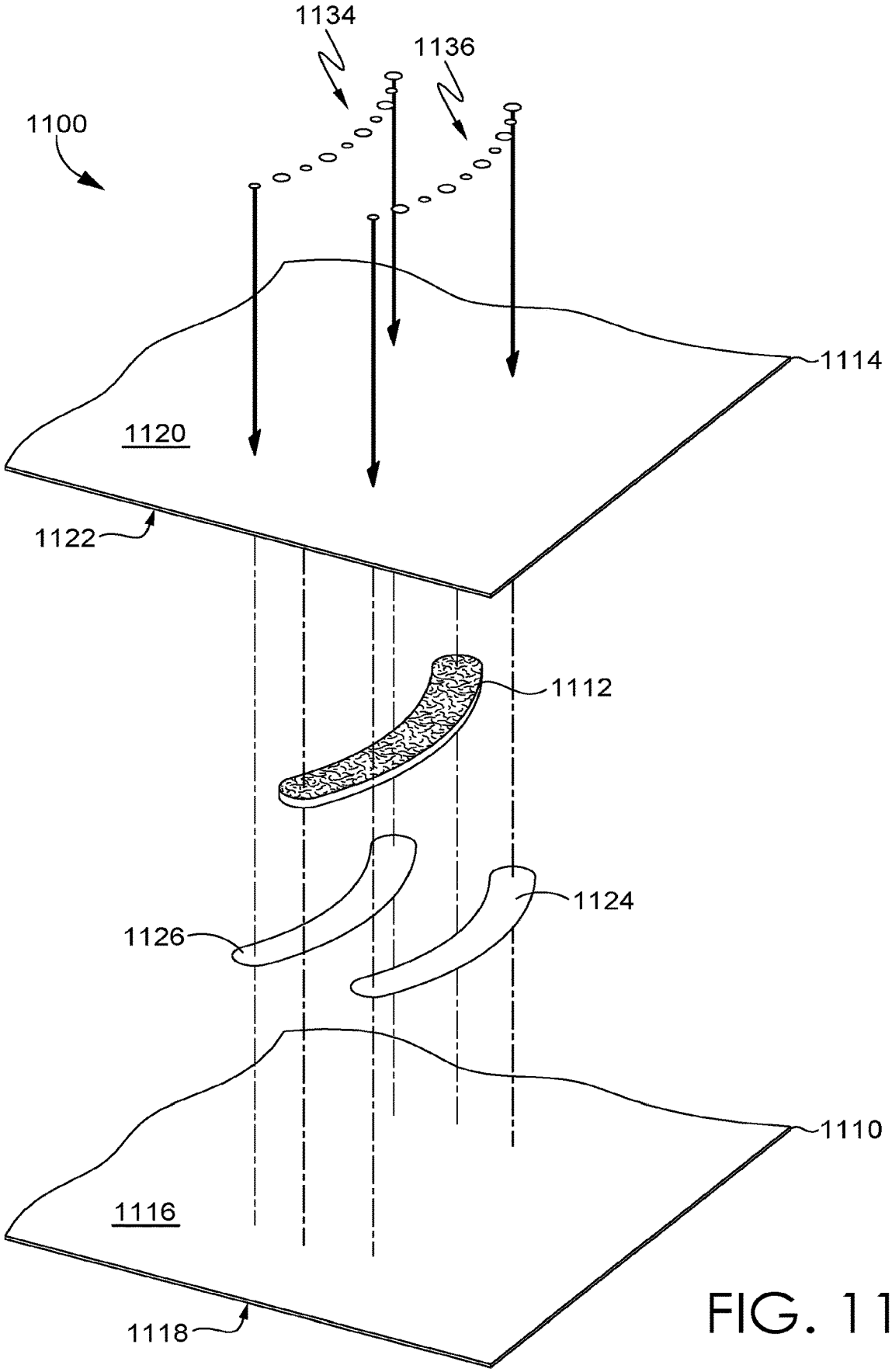
FIG. 11 illustrates an exploded view of a second exemplary construction for an insulated vented garment in accordance with aspects herein.

Turning now to FIG. 11, an exploded view of a second exemplary construction 1100 for an insulated vented garment is provided in accordance with aspects herein. The construction 1100 comprises a first pliable textile layer 1110, a second pliable textile layer 1114, and a section of non-woven polymer material 1112. In exemplary aspects, the first textile layer 1110 may comprise a first surface 1116 and an opposite second surface 1118, and the second textile layer 1114 may comprise a third surface 1120 and an opposite fourth surface 1122. When the construction 1100 is used in the garment, the third surface 1120 of the second textile layer 1114 may comprise an outer-facing surface of the garment or garment panel, and the second surface 1118 of the first textile layer 1110 may comprise an inner-facing surface of the garment or garment panel.

In exemplary aspects, the first textile layer 1110 and the second textile layer 1114 may have a similar pattern shape. However, it is also contemplated herein that the first textile layer 1110 and the second textile layer 1114 may comprise different pattern shapes. For example, the first textile layer 1110 may have a pattern shape comprising a smaller surface area than the second textile layer 1114. To describe it a different way, the first textile layer 1110 may be applied to the second textile layer 1114 as sections or "patches" at one or more areas of the second textile layer 1114. Thus, the insulation features described herein using the first and second textile layers 1110 and 1114, and the section of non-woven polymer material 1112 may be incorporated at one or more discrete portions of a garment or apparel item. This will be described further with respect to FIG. 13.

Similar to the construction 100, the first textile layer 1110 and the second textile layer 1114 may comprise a knitted, woven, or non-woven textile. Further, the first textile layer 1110 may be formed of the same material (e.g., knit or woven material) as the second textile layer 1114, or the layers 1110 and 1114 may be formed of different materials (i.e., the first textile layer 1110 may be a knit material and the second textile layer 1114 may be a woven material or vice versa). In exemplary aspects, one or more of the layer 1110 and/or 1114 may be treated with a durable water repellant (DWR) to make the resulting garment substantially impervious to water. For instance, the second textile layer 1114, since it is an outer-facing layer, may be treated with a DWR finish. Moreover, the first textile layer 1110 may be finished such that is has a soft feel or hand. Finishing may include, for example, brushing the second surface 1118 of the first textile layer 1100. Any and all aspects, and any variation thereof, are contemplated as being within aspects herein.

It is further contemplated herein that one or more of the first textile layer 1110 and/or the second textile layer 1114 may be formed from fabrics having different weights. For instance, the layers 1110 and/or 1114 may be formed of light fabrics (89 $g/m^2$ to 30 $g/m^2$) or even ultra-light fabrics (29 $g/m^2$ or lighter). However, it is contemplated herein that heavier fabrics, such as fabrics with weights in the range of 90 $g/m^2$ to 149 $g/m^2$ or even 150 $g/m^2$ to 250 $g/m^2$ or higher may be used for the layers 110 and/or 114 in accordance with aspects herein.

The section of non-woven polymer material 1112 is shown as having a curved strip-like shape. However, it is contemplated herein that the section of non-woven polymer material 1112 may comprise different shapes as described above. The section of non-woven polymer material 1112 is further shown as being positioned between the first and second textile layers 1110 and 1114. More specifically, the section of non-woven polymer material 1112 is shown as being positioned between the first surface 1116 of the first textile layer 1110 and the fourth surface 1122 of the second textile layer 1114.

Similar to the non-woven polymer sheet 112 in FIG. 1, the section of non-woven polymer material 1112 is contemplated to have a cohesive or unitary structure due to, for example, entanglement of fibers used to form the section of non-woven polymer material 1112. In exemplary aspects, the section of non-woven polymer material 1112 may be cut from a non-woven polymer sheet using, for example, a mechanical cutting process, laser cutting, ultrasonic cutting, water jet cutting, and the like. In other exemplary aspects, the section of non-woven polymer material 1112 may be formed to have the shape shown. Any and all aspects, and any variation thereof, are contemplated as being within aspects herein.

The construction 1100 further comprises a first adhesive material 1124 and a second adhesive material 1126. In exemplary aspects, the first adhesive material 1124 and the second adhesive material 1126 may comprise an adhesive tape formed to have a shape generally corresponding to the shape of the section of non-woven polymer material 1112. The first adhesive material 1124 and the second adhesive material 1126 may be used to bond the first textile layer 1110 to the second textile layer 1114.

To assemble the construction 1100, the section of non-woven polymer material 1112 may be secured to the first surface 1116 of the first textile layer 1110, and the first and second adhesive materials 1124 and 1126 may be positioned adjacent to the section of non-woven polymer material 1112 on the first surface 1116 of the first textile layer 1110. More particularly, the first adhesive material 1124 and the second adhesive material 1126 may be positioned on the first surface 1116 of the first textile layer 1110 adjacent to the section of non-woven polymer material 1112 on opposing sides of the section of non-woven polymer material 1112. As used with respect to this aspect, the term "adjacent" may mean within 0.0 mm to 20.0 mm of an edge of the section of non-woven polymer material 1112. The fourth surface 1122 of the second textile layer 1114 may then be positioned adjacent to the first surface 1116 of the first textile layer 1110. The two layers 1110 and 1114 may be pressed together with sufficient force and/or energy applied in the areas generally corresponding to the adhesive materials 1124 and 1126 to activate the adhesive materials 1124 and 1126 and cause a bond between the two layers 1110 and 1114. The adhesive materials 1124 and 1126 may be activated by, for instance, heat, or ultrasonic energy, or any other type of applied energy. In the construction 1100, the first and second textile layers 1110 and 1114 are un-affixed or un-bonded in areas corresponding to the section of non-woven polymer material 1112.

Once the first textile layer 1110 and the second textile layer 1114 are bonded together, seams are formed at the bonded areas. In other words, a seam is formed at an area corresponding to the first adhesive material 1124 and a seam is formed at an area corresponding to the second adhesive material 1126. It is contemplated herein, that instead of positioning the first and second adhesive materials 1124 and 1126 adjacent to the first textile layer 1110, the adhesive materials 1124 and 1126 may be positioned adjacent to the second textile layer 1114. It is further contemplated herein that additional adhesive materials may be used to bond the first and second textile layers 1110 and 1114 together in areas adjacent to the section of non-woven polymer material 1112. Any and all aspects, and any variation thereof, are contemplated as being within aspects herein.

The construction 1100 further comprises one or more optional perforations 1134 and 1136. In exemplary aspects, the perforations 1134 may be made through the second textile layer 1114 and the first textile layer 1110 in the area corresponding to the second adhesive material 1126, and the perforations 1136 may be made through the second textile layer 1114 and the first textile layer 1110 in the area corresponding to the first adhesive material 1124. To put it another way, the perforations 1134 are formed at the seam area created when the first textile layer 1110 is affixed or bonded to the second textile layer 1114 using the second adhesive material 1126. And the perforations 1136 are formed at the seam area created when the first textile layer 1110 is affixed or bonded to the second textile layer 1114 using the first adhesive material 1124. The perforations 1134 and 1136 may be formed using, for instance, a mechanical cutting process, a knitting or weaving process, laser cutting, water jet cutting, ultrasonic cutting, and the like. As stated above, the perforations 1134 and 1136 may be used to allow moisture vapor or excess heat produced by the wearer to exit the garment.

Figure 12A:
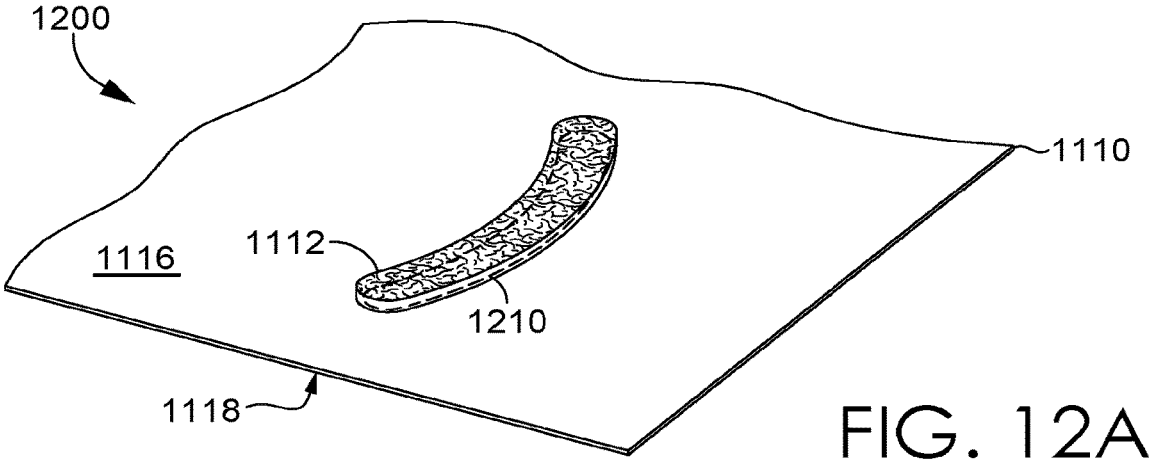
FIG. 12A illustrates a top perspective view of a construction detail for the second exemplary construction of FIG. 11 in accordance with aspects herein.

Turning to FIG. 12A, referenced generally by the numeral 1200, a top perspective view of a portion of the construction 1100 is shown comprising the section of non-woven polymer material 1112 positioned on the first surface 1116 of the first textile layer 1110 in accordance with aspects herein. Before affixing the first textile layer 1110 to the second textile layer 1114 using the first and second adhesive materials 1124 and 1126 as described above, the section of non-woven polymer material 1112 may be secured to the first textile layer 1110 to prevent shifting of the section of non-woven polymer material 1112 during manipulation of the construction 1100. In an exemplary aspect, this may be done by tacking or stitching the section of non-woven polymer material 1112 along its perimeter edge as indicated by the reference numeral 1210. However, other ways of securing the section of non-woven polymer material 1112 to the first textile layer 1110 are contemplated herein such as using an adhesive, bonding, spot welding, and the like. It is also contemplated herein that instead of securing the section of non-woven polymer material 1112 to the first textile layer 1110, it may be secured to the second textile layer 1114 or to both the first and second textile layers 1110 and 1114. Any and all aspects, and any variation thereof, are contemplated as being within aspects herein.

Figure 12B:
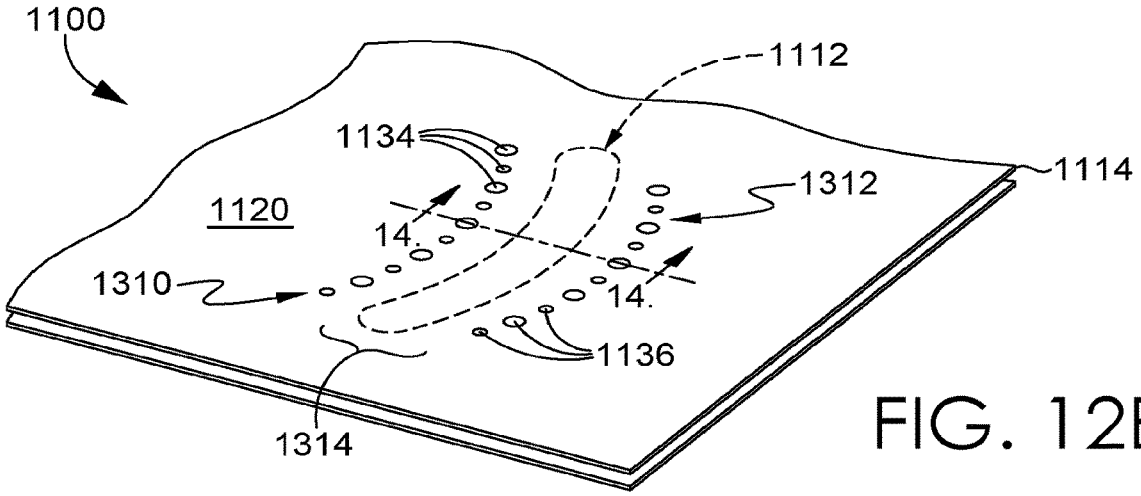
FIG. 12B illustrates a top perspective view of the second exemplary construction of FIG. 11 when in an as-assembled state in accordance with aspects herein.

FIG. 12B illustrates a top perspective view of the construction 1100 in an as-assembled state in accordance with aspects herein. As shown, the second textile layer 1114 is positioned adjacent the first textile layer 1110 such that the third surface 1120 of the second textile layer 1114 is exposed. The section of non-woven polymer material 1112 is positioned between the first and second textile layers 1110 and 1114 as indicated by the dashed line. As discussed, the first textile layer 1110 and the second textile layer 1114 are bonded or secured to each other at a first seam 1310 corresponding to the second adhesive material 1126 and a second seam 1312 corresponding to the first adhesive material 1124. It is contemplated herein that the first textile layer 1110 and the second textile layer 1114 may be generally unsecured or unaffixed to each other except at the seams 1310 and 1312. The seams 1310 and 1312 are positioned adjacent to and on opposing sides of the section of non-woven polymer material 1112 and help to define a chamber 1314 containing the section of non-woven polymer material 1112. To describe it another way, the chamber 1314 is bounded or defined on at least two sides by the seams 1310 and 1312 but may not be defined by seams at the ends of the chamber 1314 (i.e., it is an open-ended chamber 1314). The creation of open-ended chambers, such as the chamber 1314 is possible due to the cohesive or unitary construction of the section of non-woven polymer material 1112 as opposed to loose fill materials that may need to be completely enclosed within a chamber to prevent drift.

FIG. 12B further illustrates the optional perforations 1134 and 1136. The perforations 1134 are positioned at the first seam 1310 and extend through the first and second textile layers 1110 and 1114 in this area. Similarly, the perforations 1136 are positioned at the second seam 1312 and extend through the first and second textile layers 1110 and 1114 in this area.

Figure 13:
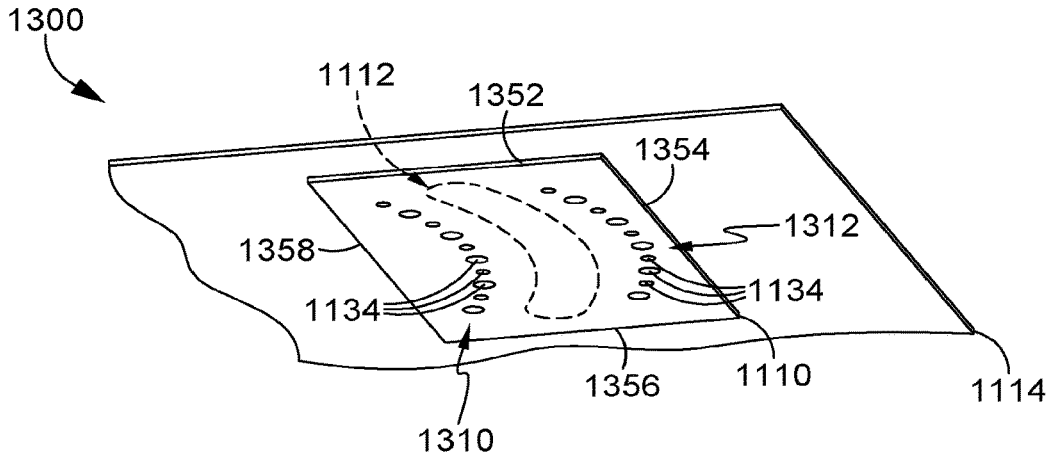
FIG. 13 illustrates an alternative configuration for the second exemplary construction in accordance with aspects herein.

As described above, it is contemplated herein that the first textile layer 1110 may have a different pattern shape than the second textile layer 1114 such that the first textile layer 1110 has a smaller surface area than the second textile layer 1114. This is shown in FIG. 13, referenced generally by the numeral 1300, which depicts a bottom perspective view of an alternative configuration for the construction 1100 where the first textile layer 1110 has a different pattern shape than the second textile layer 1114. In this aspect, the first textile layer 1110 is defined by perimeter edges 1352, 1354, 1356, and 1358, and the surface area of the first textile layer 1110 is less than the surface area of the second textile layer 1114. Besides being secured to the second textile layer 1114 at the bonded seams 1310 and 1312, the first textile layer 1110 may also be secured to the second textile 1114 along its perimeter edges 1352, 1354, 1356, and 1358. This may through the use of an adhesive seam tape, bonding, stitching, welding, and the like. In exemplary aspects, the remaining portions of the first textile layer 1110 may remain un-affixed to the second textile layer 1114.

The configuration shown in FIG. 13 enables the formation of insulated and vented sections at various portions of a garment formed using, for instance, the second textile layer 1114. For instance, the second textile layer 1114 may be used to form a garment such as a shirt. In areas needing a higher amount of insulation, sections of the first textile layer 1110 may be used to form the construction 1100 shown in FIG. 11. By limiting the areas in which the first textile layer 1110 is used, a lighter-weight construction may be achieved while still having needed insulation features.

Figure 14:
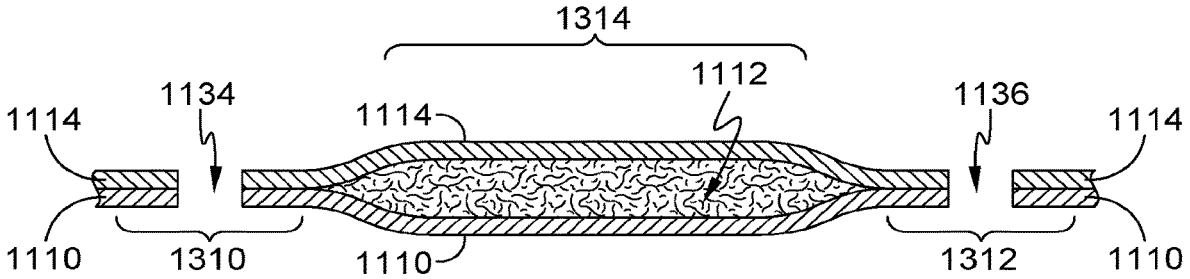
FIG. 14 illustrates a cross-sectional view taken along cut line 14-14 of FIG. 12B in accordance with aspects herein.

Continuing, a cross-section of the construction 1100 taken along cut line 14-14 of FIG. 12B is shown in FIG. 14 in accordance with aspects herein. The seams 1310 and 1312 are shown as being positioned adjacent to the chamber 1314 containing the section of non-woven polymer material 1112. In other words, the chamber 1314 comprises the first textile layer 1110, the section of non-woven polymer material 1112, and the second textile layer 1114. As shown, the seams 1310 and 1312 comprise just the first and second textile layers 1110 and 1114. The perforation 1134 is shown as extending through the first and second textile layers 1110 and 1114 at the seam 1310, and the perforation 1136 is shown as extending through the first and second textile layers 1110 and 1114 at the seam 1312.

Although the construction 1100 is shown comprising one section of non-woven polymer material 1112, it is contemplated herein that the construction 1100 may comprise multiple sections of non-woven polymer material, where each section is separated from an adjacent section of non-woven polymer material by a seam, where the seam may comprise optional perforations. Any and all aspects, and any variation thereof, are contemplated as being within aspects herein.

Figure 15:
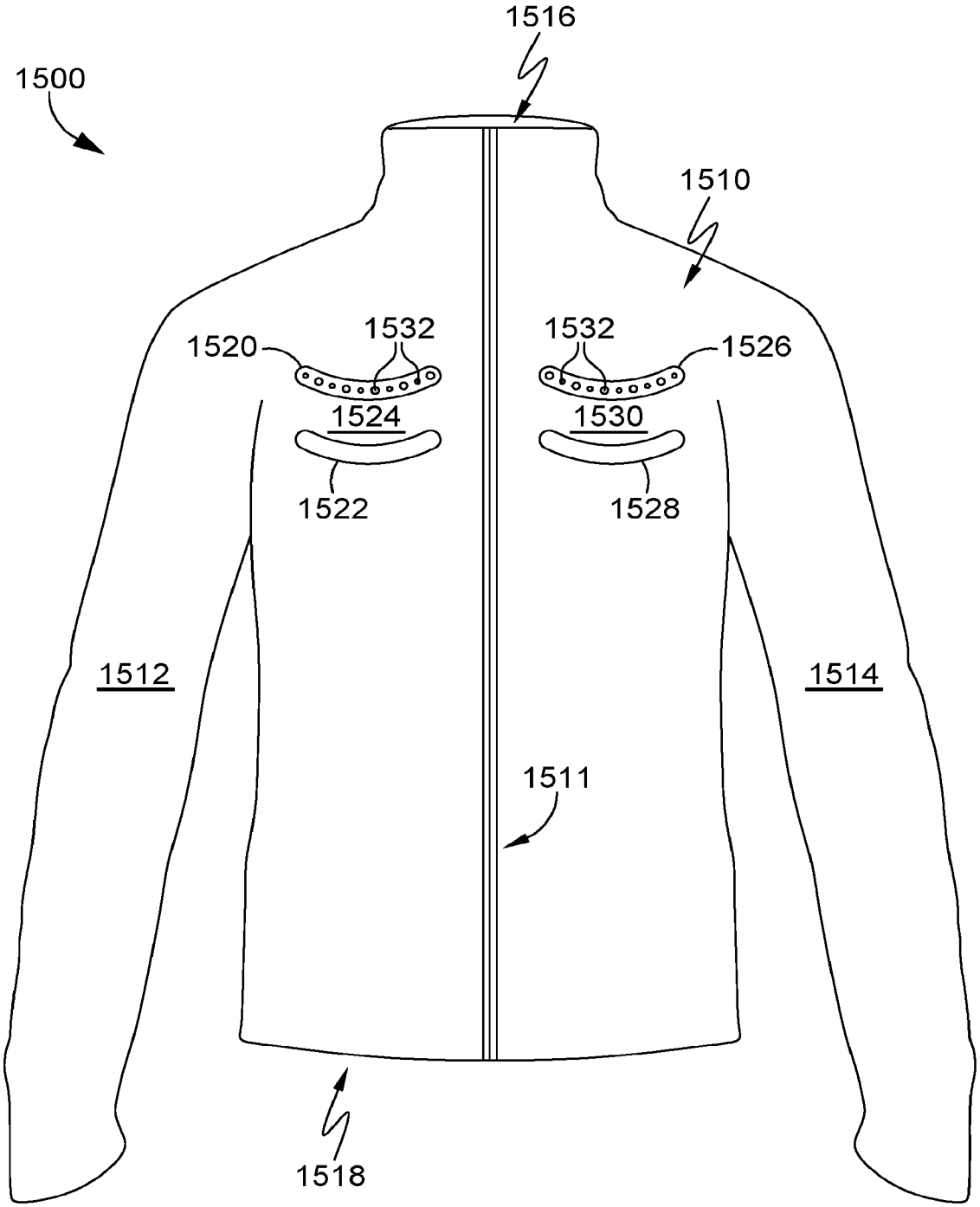
FIG. 15 illustrates a front view of an exemplary insulated vented garment formed, for example, using the second exemplary construction of FIG. 11 in accordance with aspects herein.

Turning to FIG. 15, a front view of a garment 1500 having the construction 1100 is shown in accordance with aspects herein. The garment 1500 is shown in the form of a jacket although it is contemplated herein that the garment 1500 may take other forms such as a shirt, a pull-over hoodie, a vest, a pant, a short, a body suit, a sock, a hat, a shoe, and the like. The garment 1500 comprises a torso portion 1510 configured to cover the front and back torso of a wearer when the garment 1500 is in an as-worn configuration. The torso portion 1510 may comprise an optional releasable fastener mechanism 1511 such as a zipper used to open and close the garment 1500. The torso portion 1510 defines at least a neck opening 1516, a waist opening 1518, and first and second sleeve openings (not shown). The neck opening 1516, in turn, may be defined by a collar portion. The garment 1500 may optionally comprise a first sleeve portion 1512 extending from the torso portion 1510 at the first sleeve opening, and a second sleeve portion 1514 extending from the torso portion 1510 at the second sleeve opening.

Some are all of the garment 1500 may comprise the construction 1100 shown in FIGS. 11-14. For instance, it is contemplated herein that an entirety of the torso portion 1510 may be formed of the construction 1100. In some aspects, the first and second sleeve portions 1512 and 1514 may also be formed from the construction 1100.

Similar to the garment 500, it is also contemplated herein that the construction 1100 may be used on only portions of the garment 1500. For instance, the garment 1500 may be zoned into different areas such as areas needing a high amount of insulation, a moderate amount of insulation, and areas needing a low amount of insulation.

Continuing, areas needing a high to moderate amount of insulation may be formed from the construction 1100. However, seams formed in these areas may not be perforated. Areas needing a low amount of insulation may also be formed from the construction 1100. Seams in these areas may be perforated to increase permeability and breathability in these areas. Alternatively, areas needing a low amount of insulation may be formed without using the construction 1100. For instance, these areas may not comprise sections of non-woven polymer material 1112 and instead may comprise just the first and second textile layers 1110 and 1114, just one of the layers 1110 or 1114, or the areas may comprise a different textile such as, for instance, a mesh material for greater permeability and breathability. Any and all aspects, and any variation thereof, are contemplated as being within aspects herein.

Referring particularly to the garment 1500, the garment 1500 comprises a number of seams such as seam 1520 and seam 1522 located on an upper aspect of the torso portion 1510 on a first lateral side, and seam 1526 and 1528 located on an upper aspect of the torso portion 1510 on a second opposite lateral side. In an optional aspect, the seams 1520, 1522, 1526, and 1528 may be reinforced with stitching. The stitching may be along one edge of the seams 1520, 1522, 1526, and 1528 or along both edges of the seams 1520, 1522, 1526, and 1528. Any and all aspects, and any variation thereof, are contemplated as being within aspects herein.

In exemplary aspects, the seam 1520 and the seam 1522 define a first chamber 1524 comprising a section of non-woven polymer material, and the seam 1526 and the seam 1528 defined a second chamber 1530 comprising an additional section of non-woven polymer material. The chambers 1524 and 1530 are shown as being defined on two sides by seams but as being open at each end. Some or all of the seams 1520, 1522, 1526, and 1528 may be perforated. For instance, the seams 1520 and 1526 are shown as comprising perforations 1532. Similar to the discussion of the perforations with respect to the garment 500, the perforations 1532 may comprise different sizes, shapes, and may be formed continuously or intermittently along the seams 1520 and 1526. Any and all aspects, and any variation thereof, are contemplated as being within aspects herein.

Although the seams 1520, 1522, 1526, and 1528 and the chambers 1524 and 1530 are shown in a generally horizontal orientation, it is contemplated herein that the garment 1500 may comprise seams and chambers that have a generally vertical orientation or that assume a more curvilinear or organic shape such as the exemplary shapes shown in FIGS. 9A and 9B. Moreover, the placement of the seams 1520, 1522, 1526, and 1528 and the chambers 1524 and 1530 shown in FIG. 15 is exemplary only and other patterns are contemplated herein such as the pattern shown in FIG. 5 for the garment 500. Although not shown, it is further contemplated that the back of the garment 1500 may also comprise seams, chambers, and/or perforations. For instance, the back of the garment 1500 may have a pattern of seams, chambers, and/or perforations similar to that shown for the garment 500 in FIG. 6. Any and all aspects, and any variation thereof, are contemplated as being within aspects herein.

Figure 16:
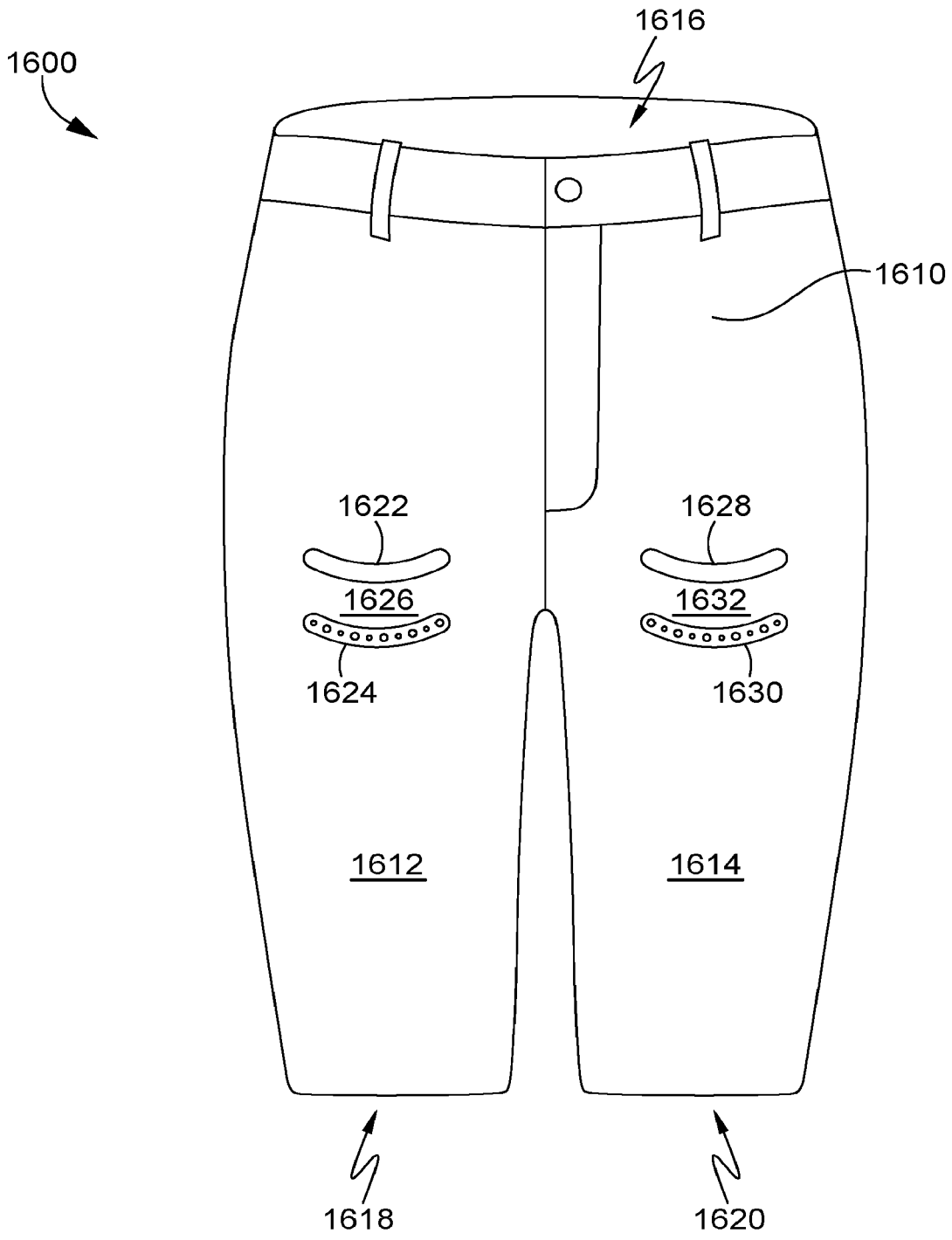
FIG. 16 illustrates a front view of an exemplary insulated vented garment formed, for example, using the second exemplary construction of FIG. 11 in accordance with aspects herein.

FIG. 16 illustrates a front view of a garment 1600 also formed using the construction 1100 in accordance with aspects herein. The garment 1600 is in the form of a short although it is contemplated herein that the garment 1600 may be in the form of a pant, a three-quarter pant, a capri, a tight, and the like. The garment 1600 comprises a torso portion 1610 adapted to cover a lower torso of a wearer when the garment 1600 is worn, a first leg portion 1612, and a second leg portion 1614. The torso portion 1610 along with the first and second leg portions 1612 and 1614 help to define at least in part a waist opening 1616, a first leg opening 1618, and a second leg opening 1620.

Similar to the garment 700 of FIGS. 7 and 8, the garment 1600 may be configured to provide varying levels of insulation over different portions of the garment 1600. As such, the construction over different parts of the garment 1600 may vary to include areas having sections of non-woven polymer material, areas without sections of non-woven polymer material, seams with perforations, seams without perforations, no seams, and the like.

As shown in FIG. 16, the garment 1600 comprises seams 1622 and 1624 located on the first leg portion 1612 such that they are configured to be positioned adjacent to a right anterior thigh area of a wearer when the garment 1600 is worn. The seams 1622 and 1624 define at least in part a chamber 1626 comprising a section of non-woven polymer material. Similarly, the garment 1600 further comprises seams 1628 and 1630 located on the second leg portion 1614 such that they are configured to be positioned adjacent to a left anterior thigh area of a wearer when the garment 1600 is worn. Some or all of the seams 1622, 1624, 1628, and 1630 may be perforated. For example, seam 1624 and seam 1630 are shown as comprising perforations in FIG. 16.

Although the seams 1622, 1624, 1628, and 1630 and the chambers 1626 and 1632 are shown in a generally horizontal orientation, it is contemplated herein that the seams 1622, 1624, 1628, and 1630 and the chambers 1626 and 1632 may assume a more vertical orientation or they may assume a more curvilinear or organic aspects. Moreover, the placement of the seams 1622, 1624, 1628, and 1630 and the chambers 1626 and 1632 shown in FIG. 16 is exemplary only and other patterns are contemplated herein such as the pattern shown in FIG. 7 for the garment 700. Although not shown, it is further contemplated that the back of the garment 1600 may also comprise seams, chambers, and/or perforations. For instance, the back of the garment 1600 may have a pattern of seams, chambers, and/or perforations similar to that shown for the garment 700 in FIG. 8. Any and all aspects, and any variation thereof, are contemplated as being within aspects herein.

Figure 17:
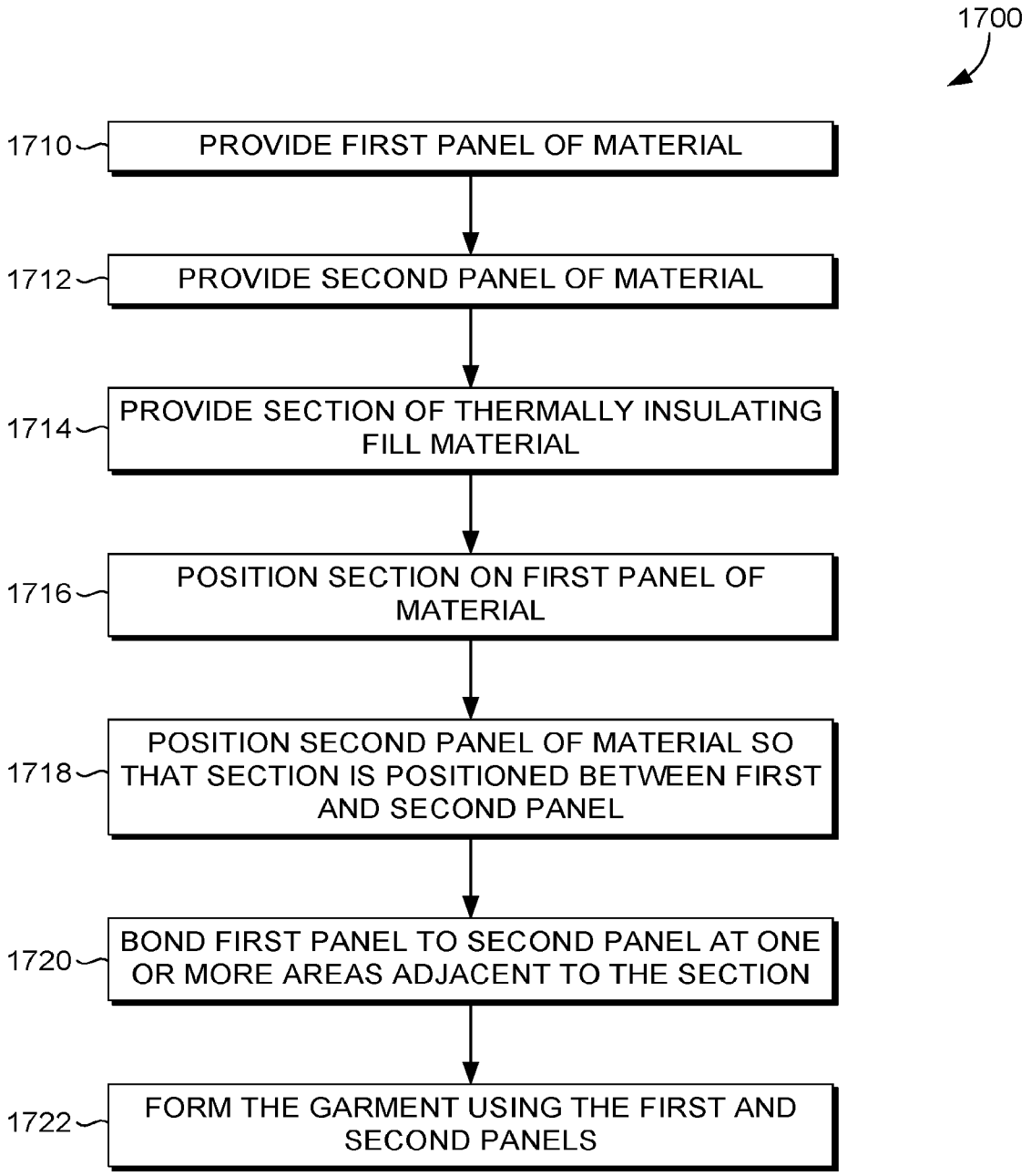
FIG. 17 illustrates a flow diagram of an exemplary method of forming an insulated vented garment in accordance with aspects herein.

Turning to FIG. 17, a flow diagram of an exemplary method 1700 of forming an insulated, vented garment using sections or strips of non-woven polymer material or thermally insulating fill material is provided in accordance with aspects herein. At a step 1710, a first panel of material, such as the first textile layer 1110, is provided, and, at a step 1712, a second panel of material, such as the second textile layer 1114, is provided. In exemplary aspects, the first and second panels of material may comprise pliable knitted, woven, or non-woven textiles.

At a step 1714, a section of thermally insulating fill material, such as the section of non-woven polymer material 1112, is provided. The section of thermally insulating fill material may be cut from a sheet of thermally insulating fill material, or the section of thermally insulating fill material may be formed to have a specific shape as needed for construction.

At a step 1716, the section of thermally insulating fill material is positioned between the first and second panels of material. In exemplary aspects, the section of thermally insulating fill material may be secured to the first panel of material and/or the second panel of material by stitching or tacking the section of thermally insulating fill material along its perimeter edge to the panel(s). Other ways of securing the section of thermally insulating fill material to the first and/or second panels of material are contemplated herein such as using adhesives, bonding, spot welding, and the like.

At a step 1718, the first and second panels of material are positioned adjacent to each other such that the section of thermally insulating fill material is interposed or positioned between the first and second panels. At a step 1720, the first and second panels of material are secured to each other in areas adjacent to the section of thermally insulating fill material to form seams. In exemplary aspects, this may occur by providing an adhesive material, such as an adhesive sheet, that is formed (e.g., cut) to have a shape corresponding to the general shape of the section of thermally insulating fill material. The adhesive material is positioned between the first and second panels of material such that it is positioned adjacent to one or more edges of the section of thermally insulating fill material. The adhesive material is activated by the application of, for example, heat, light, ultrasound, pressure, and the like in the areas adjacent to the section of thermally insulating fill material to bond the first panel of material to the second panel of material. A similar process is contemplated for additional sections of thermally insulating fill material. At a step 1722, the garment is formed using at least the bonded assembly described above.

Additional method steps are contemplated herein. For instance, perforations may be formed through some or all of the seams to impart breathability characteristics to the garment in addition to the insulation characteristics provided by the use of the sections of thermally insulating fill material. It is further contemplated herein that the seams formed in the areas adjacent to the sections of thermally insulating fill material may be reinforced with stitching. The listing of the method steps 1700 is exemplary only, and it is contemplated herein that the steps may take place in other orders unless specified otherwise.

As described, aspects herein are directed to a method of forming an insulated vented garment using sections of non-woven polymer material such as a poly-fill material. Aspects herein are further directed to an insulated vented garment formed using sections of non-woven polymer material. The use of sections of non-woven polymer material provides an economical and efficient production method, and garments produced using this type of construction may comprise organically shaped or curvilinear chambers that can be positioned on the garment to provide targeted insulation and venting features.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A garment comprising:

an inner panel;

an outer panel;

a non-woven thermally insulating fill sheet interposed between the inner panel and the outer panel, wherein the non-woven thermally insulating fill sheet comprises a first surface and a second opposite surface;

a high insulation area comprising:

a first portion of the inner panel, a first portion of the outer panel, and a first portion of the non-woven thermally insulating fill sheet, wherein the first portion of the non-woven thermally insulating fill sheet lacks openings, and is interposed between the first portion of the inner panel and the first portion of the outer panel;

a moderate insulation area comprising:

a second portion of the inner panel, a second portion of the outer panel, a second portion of the non-woven thermally insulating fill sheet, wherein the second portion of the non-woven thermally insulating fill sheet is interposed between the second portion of the inner panel and the second portion of the outer panel, the second portion of the non-woven thermally insulating fill sheet comprising a first number of openings that extend between the first surface and the second opposite surface of the non-woven thermally insulating fill sheet, the first number of openings each having a first perimeter edge defining a first length and a first width, the first length being greater than the first width, and a first number of seams adhesively bonding the inner panel to the outer panel at areas corresponding to the first number of openings of the second portion of the non-woven thermally insulating fill sheet.

2. The garment of claim 1, further comprising:

a low insulation area comprising:

a third portion of the inner panel, a third portion of the outer panel, a third portion of the non-woven thermally insulating fill sheet, wherein the third portion of the non-woven thermally insulating fill sheet is interposed between the third portion of the inner panel and the third portion of the outer panel, the third portion of the non-woven thermally insulating fill sheet comprising a second number of openings that extend between the first surface and the second opposite surface of the non-woven thermally insulating fill sheet, the second number of openings each having a second perimeter edge defining a second length and a second width, wherein the second length is greater than the second width, and a second number of seams adhesively bonding the third portion of the inner panel to the third portion of the outer panel at areas corresponding to the second number of openings of the third portion of the non-woven thermally insulating fill sheet, wherein the second number of seams is greater than the first number of seams.

3. The garment of claim 1, further comprising a low insulation area formed from a third portion of the inner panel and a third portion of the outer panel.

4. The garment of claim 3, wherein the low insulation area does not include the non-woven thermally insulating fill sheet.

5. The garment of claim 1 further comprising a low insulation area formed from a single panel of material.

6. The garment of claim 5, wherein the single panel of material is a mesh material.

7. The garment of claim 1, wherein the garment is an upper-torso garment, and wherein the high insulation area includes a first sleeve and a second sleeve of the upper-torso garment.

8. The garment of claim 7, wherein the moderate insulation area includes a front of a torso portion of the upper-torso garment.

9. The garment of claim 1, wherein the garment is a lower-torso garment.

10. The garment of claim 1, wherein one or more of the first number of seams includes a first number of perforations within the first perimeter edge that extend through the inner panel and the outer panel along a respective seam of the one or more of the first number of seams.

11. The garment of claim 10, further comprising:

a low insulation area comprising:

a third portion of the inner panel, a third portion of the outer panel, a third-portion of the non-woven thermally insulating fill sheet, wherein the third portion of the non-woven thermally insulating fill sheet is interposed between the third portion of the inner panel and the third portion of the outer panel, the third portion of the non-woven thermally insulating fill sheet comprising a second number of openings that extend between the first surface and the second opposite surface of the non-woven thermally insulating fill sheet, the second number of openings each having a second perimeter edge defining a second length and a second width, wherein the second length is greater than the second width, and a second number of seams that directly join the inner panel to the outer panel at areas corresponding to the second number of openings of the third portion of the non-woven thermally insulating fill sheet, wherein one or more of the second number of seams includes a second number of perforations within the second perimeter edge that extend through the inner panel and the outer panel along a respective seam of the one or more of the second number of seams, and wherein the second number of perforations is greater than the first number of perforations.

12. An upper-torso garment comprising:

a first sleeve and a second sleeve, each of the first sleeve and the second sleeve comprising:

a sleeve inner panel, a sleeve outer panel, and a sleeve continuous non-woven thermally insulating fill sheet interposed between the sleeve inner panel and the sleeve outer panel; and a torso portion, wherein a front of the torso portion comprises:

a front inner panel, a front outer panel, a front non-woven thermally insulating fill sheet interposed between the front inner panel and the front outer panel, the front non-woven thermally insulating fill sheet comprising a first surface, an opposite second surface, and a first number of openings that extend between the first surface and the second opposite surface of the front non-woven thermally insulating fill sheet, wherein each of the first number of openings has a first perimeter edge defining a first length and a first width, wherein the first length is greater than the first width, a first number of seams securing the front-non-woven thermally insulating fill sheet to the front inner panel and the front outer panel by adhesively bonding the front inner panel and the front outer panel at areas corresponding to the first number of openings of the front non-woven thermally insulating fill sheeted, and a first number of perforations located within the first perimeter edge of one or more openings of the first number of openings, wherein the first number of perforations extend through the front inner panel and the front outer panel.

13. The upper-torso garment of claim 11, wherein a back of the torso portion comprises:

a back inner panel, a back outer panel, a back non-woven thermally insulating fill sheet interposed between the back inner panel and the back outer panel, the back non-woven thermally insulating fill sheet comprising a third surface, an opposite fourth surface, and a second number of openings that extend between the third surface and the opposite fourth surface of the back non-woven thermally insulating fill sheet, and a second number of seams securing the front-non-woven thermally insulating fill sheet to the back inner panel and the back outer panel by adhesively bonding the back inner panel and the back outer panel at areas corresponding to the second number of openings of the back non-woven thermally insulating fill sheet.

14. The upper-torso garment of claim 13, wherein the second number of seams is greater than the first number of seams.

15. The upper-torso garment of claim 13, further comprising a second number of perforations located within a second perimeter edge of one or more openings of the second number of openings, wherein the second number of perforations extend through the back inner panel and the back outer panel.

16. The upper-torso garment of claim 15, wherein the second number of perforations is greater than the first number of perforations.

17. A garment comprising:

an inner panel;

an outer panel; and a non-woven thermally insulating fill sheet having a first surface and a second opposite surface that is interposed between the inner panel and the outer panel;

the garment further comprising:

a moderate insulation area comprising:

a first portion of the inner panel, a first portion of the outer panel, a first portion of the non-woven thermally insulating fill sheet interposed between the first portion of the inner panel and the first portion of the outer panel, the first portion of the non-woven thermally insulating fill sheet comprising a first number of openings that extend between the first surface and the second opposite surface of the non-woven thermally insulating fill sheet, the first number of openings each having a first perimeter edge defining a first length and a first width, wherein the first length is greater than the first width, and a first number of seams that directly join the first portion of the inner panel to the first portion of the outer panel at areas corresponding to the first number of openings of the first portion of the non-woven thermally insulating fill sheet; and a low insulation area comprising:

a second portion of the inner panel, a second portion of the outer panel, a second portion of the non-woven thermally insulating fill sheet interposed between the second portion of the inner panel and the second portion of the outer panel, the second portion of the non-woven thermally insulating fill sheet comprising a second number of openings that extend between the first surface and the second opposite surface of the non-woven thermally insulating fill sheet, the second number of openings each having a second perimeter edge defining a second length and a second width, and a second number of seams that directly join the second portion of the inner panel to the second portion of the outer panel at areas corresponding to the second number of openings of the second portion of the non-woven thermally insulating fill sheet, wherein the second number of seams is greater than the first number of seams.

18. The garment of claim 17, wherein the second number of seams includes one or more perforations within the second perimeter edge that extend through the second number of seams, the second portion of the inner panel, and the second portion of the outer panel.

19. The garment of claim 17, wherein the garment is an upper-torso garment.

20. The garment of claim 17, wherein the garment is a lower-torso garment.

* * * * *